United States Patent [19]

Nakamura

[11] Patent Number: 4,591,762

[45] Date of Patent: May 27, 1986

[54] ELECTRONIC FLASH

[75] Inventor: Hiroaki Nakamura, Hachioji, Japan

[73] Assignee: Olympus Optical, Co., Tokyo, Japan

[21] Appl. No.: 607,571

[22] Filed: May 7, 1984

[30] Foreign Application Priority Data

May 31, 1983 [JP] Japan ..... 58-097622
Jun. 7, 1983 [JP] Japan ..... 58-102217
Jun. 7, 1983 [JP] Japan ..... 58-102218

[51] Int. Cl.[4] ..... H05B 37/00

[52] U.S. Cl. ..... 315/241 P; 315/207; 315/208

[58] Field of Search ..... 315/241 P, 207, 208

[56] References Cited

U.S. PATENT DOCUMENTS 3,896,333 7/1975 Nakamura ..... 315/241 P
3,940,659 2/1976 Kojima et al. ..... 315/241 P
4,344,020 8/1982 Horinski ..... 315/241 P

FOREIGN PATENT DOCUMENTS 5419777 12/1972 Japan .
48-766 1/1973 Japan .
48-40421 11/1973 Japan .
5741686 1/1974 Japan .
53-106117 9/1978 Japan .
54-27264 9/1979 Japan .
55-129327 10/1980 Japan .

*Primary Examiner*—Harold Dixon
*Attorney, Agent, or Firm*—Louis Weinstein

[57] ABSTRACT

A series controlled electronic flash of automatic emission control type includes a switching element connected in series with a commutating switching element for selectively charging a commutation capacitor. A trigger signal is repeatedly applied to a main switching element, the commutating switching element and the charging switching element in a given sequence to enable a continued emission at substantially constant brightness level to be obtained from a flash discharge tube. A trigger capacitor may be connected with pair of switching elements for charging and discharging the trigger capacitor. A trigger signal may be repeatedly applied to the pair of switching elements for charging and discharging the trigger capacitor, to the main switching element, to the commutating switching element and the commutation capacitor charging switching element in a given sequence, thereby allowing a multiple emission to be obtained intermittently and at a high rate from the flash discharge tube.

29 Claims, 10 Drawing Figures

ELECTRONIC FLASH

BACKGROUND OF THE INVENTION

The invention relates to an electronic flash, and more particularly, to an electronic flash which permits rapid charging of a commutation capacitor, a continued emission of flashlight from a flash discharge tube for a given time interval in response to a single trigger operation, a rapid triggering operation or an interrupted series of emissions over a plurality of operations.

A conventional electronic flash, in particular, an electronic flash of series controlled type in which a switching element is connected in series with a flash discharge tube to provide an automatic emission control, includes a resistor having a high value connected in the charging path of the commutation capacitor, thereby preventing a discharge current from the flash discharge tube or an energizing current through a main thyristor, which serves as a switching element, from being bypassed through the charging path associated with the commutation capacitor. Accordingly, the magnitude of a charging current for the commutation capacitor is limited by the resistor, resulting in an inconvenience that an increased length of time is required to complete the charging of the commutation capacitor.

Specifically, FIG. 1 shows an exemplary electronic flash of the prior art which is chosen to illustrate the inconvenience mentioned above. Initially considering the arrangement of the electronic flash, it includes a power supply circuit 1 formed by a DC-DC converter which is known in itself. The positive terminal of the converter is connected to a positive bus $l_1$ through a rectifier diode D1 while the negative terminal is connected to a negative bus $l_0$. Connected across the buses $l_1$ and $l_0$ are a main capacitor C1; a series combination of a resistor R1 and a neon lamp Nel which indicates the completion of a charging operation; another series combination of a coil L1, a flash discharge tube FL1 and a main thyristor SR2; a further series combination of a resistor R3 and a commutating thyristor SR3; and an automatic emission control circuit EC1.

The anode of a thyristor SR1 is connected to the junction between the resistor R1 and the lamp Nel while the cathode is connected to the bus $l_0$. The gate of the thyristor SR1 is connected to a trigger circuit TC1 which is in turn directly connected to the bus $l_0$ and also connected to the bus $l_0$ through synchro contacts SW0 of an associated camera. The anode of the thyristor SR1 is also connected to one end of a trigger capacitor C2, the other end of which is connected to the bus $l_0$ through a primary coil of a trigger transformer T1. The secondary coil of the transformer T1 is connected to the bus $l_0$ at its one end and connected to the trigger electrode of the flash discharge tube FL1 at its other end.

The coil L1 functions to provide a smooth transition for the leading and the trailing edge of the discharge current through the discharge tube FL1, and this coil is shunted by a diode D2. The main thyristor SR2 has its anode connected to the discharge tube FL1 and its cathode connected to the bus $l_0$, while its gate is connected to the trigger circuit TC1. The anode of the thyristor SR2 is also connected to the bus $l_0$ through a resistor R2 and also connected to one end of a commutation capacitor C3, the other end of which is connected to the junction between the resistor R3 and the commutating thyristor SR3. The thyristor SR3 has its anode connected to the resistor R3 while its cathode is connected to the bus $l_0$. The gate of the thyristor SR3 is connected to the automatic emission control circuit EC1. A phototransistor PT1, which is provided for purpose of photometry, has its collector and emitter connected to the automatic emission control circuit EC1.

In operation, when the synchro contacts SW0 is turned on (i.e. closed), the trigger circuit TC1 operates to fire the both thyristors SR1 and SR2, thus initiating the emission of flashlight from the discharge tube FL1. Specifically, as the thyristor SR1 is fired, the trigger capacitor C2 is short-circuited therethrough, and the discharge of the capacitor C2 produces a current flow through the primary coil of the trigger transformer T1. This develops a high voltage across the secondary coil thereof, which is applied to the trigger electrode of the discharge tube FL1, thus exciting it. Accordingly, if the main thyristor SR2 is fired simultaneously, the main capacitor C1 discharges through a path including the coil L1, discharge tube FL1 and main thyristor SR2, whereby the discharge tube FL1 initiates its emission of flashlight.

When the phototransistor PT1 has received a proper amount of light after the initiation of the emission of flashlight from the discharge tube FL1, the automatic emission control circuit EC1 is activated and fires the commutating thyristor SR3. This causes the commutation capacitor C3 to discharge through the thyristor SR3, thus reversely biasing the main thyristor SR2, which is then turned off. The discharge current through the discharge tube FL1 then ceases, whereby the emission of flashlight terminates.

In the described arrangement, it is to be noted that the commutation capacitor C3 begins to be charged again through the resistors R3 and R2 when the current flow through the commutating thyristor SR3 reduces below a holding current level thereof to turn it off. However, the resistors R3 and R2 have such large values that the current flow through the discharge tube FL1 cannot be diverted through the resistor R2 when the thyristor SR2 is turned off and that the current flow through the resistor R3 and the thyristor SR3 is maintained below the holding current level of this thyristor when the commutating thyristor SR3 is turned on. For this reason, it takes a long time to charge the commutation capacitor C3 once the thyristor SR3 is turned off. If the commutating thyristor SR3 is re-fired before the charging of the commutation capacitor C3 is completed, there occurs no commutation, thus resulting in a failure to cease the emission of flashlight from the discharge tube FL1.

Representing the voltage to which the commutation capacitor C3 is charged by $V_3$, we have $$V_3 = V_1 \left(1 - e^{-t/C_3(R_2+R_3)}\right) \quad (1)$$

where $V_1$ represents the voltage to which the main capacitor C1 is charged, $C_3$ the capacitance of the commutation capacitor C3, $R_2$ and $R_3$ the resistance of resistors R2 and R3, respectively, and t the time. Solving the equation (1) under the initial condition that $V_3=0$ at $t=0$, we have $$t = -C_3 R \ln\left(1 - \frac{V_3}{V_1}\right) \quad (2)$$

where $R=R_2+R_3$. Substituting values of $C_3=2.2\ \mu F$, $R=40\ k\Omega$, $V_1=300$ V and $V_3=250$ V into the equation (2) yields a time length $T_0$ required to charge the commutation capacitor C3 to 250 V as follows:

$$T_0 = -2.2 \times 10^{-6} \times 40 \times 10^3 \times \ln\left(1 - \frac{250}{300}\right)$$

$$\approx 157.6 \text{ ms}$$

This means that a time interval on the order of at least 160 ms is necessary between successive commutations with a conventional electronic flash as mentioned above, considering time periods which are associated with the emission from the flash discharge tube FL1. In other words, such electronic flash will be limited to repeat its commutation in synchronism with a motor drive which is designed to take pictures at a rate of five frames per second.

As is well recognized, a photographic camera employing a focal plane shutter is subject to a disadvantage that a normal flash photography is disabled during a high speed shutter operation in which the electronic flash cannot be activated for emission in synchronism with the shutter operation. Thus, the focal plane shutter does not reach a full opening at a timing which is less than the synchronized timing of the electronic flash, while a slit defined between the first and the second blind runs in front of a film surface. In such instance, only part of the film surface is exposed to flashlight if the electronic flash is activated for emission at any time, thus preventing a uniform exposure.

To accommodate for such inconvenience, there has been proposed an electronic flash of the type which enables a continued emission substantially at a given level of flashlight during the time the slit runs in front of the film surface. Such electronic flash is disclosed in Japanese Laid-Open Patent Application No. 129,327/1980, for example. The electronic flash disclosed in this application basically comprises a series circuit formed by a flash discharge tube, a coil and a switching element connected across a main capacitor, and a diode connected in shunt with the series combination of the flash discharge tube and the coil. By turning the switching element on and off in an alternate fashion, power is derived intermittently from the main capacitor, and the time interval between the on/off condition of the switching element is controlled in accordance with a desired level of emission from the flash discharge tube so as to maintain an approximately constant emission level. During the time the switching element is on, a difference between the capacitor and the voltage across the discharge tube is applied to the coil which stores power in the form of a magnetic field, which is in turn returned to the discharge tube through the diode when the switching element is turned off, thus enabling a decayed emission from the discharge tube when the switching element is off.

However, in the described arrangement, the coil connected between the discharge tube and the switching element to limit the magnitude of the current flow acts to limit a discharge current through the discharge tube from the main capacitor, thus disadvantageously rendering it difficult to provide an emission of a uniform high level.

It should be understood that an electronic flash of the continued emission type which is available in the prior art is one which is devoted to the continued emission, and cannot also serve as an electronic flash of automatic emission control type.

Returning to the arrangement of FIG. 1, it will be noted that the trigger capacitor C2 begins to be charged through the resistor R1 again after the trigger thyristor SR1 is turned off. However, the value of the resistor R1 is chosen large enough to prevent the current flow which should pass through the discharge tube FL1 from being bypassed through the resistor R1 when the trigger thyristor SR1 is fired. Accordingly, it takes a considerable time to charge the trigger capacitor C2 after the thyristor SR1 is turned off. Hence, a second activation of the trigger circuit TC1 before the charging of the trigger capacitor C2 is complete cannot excite the discharge tube FL1 to initiate the emission of flashlight.

An electronic flash of multiple emission type is already available on the market which overcomes described disadvantages by incorporating a rapid charging controller which accomplishes a rapid charging of a trigger capacitor after each emission of flashlight so as to be ready to trigger another emission. However, the provision of such controller results in an increased size and a high price of the electronic flash, which is still incapable of achieving a reduced emission interval.

It is known that a single photograph containing a series of interrupted conditions of a continuously moving object such as the swinging process of a baseball bat or the flight of an insect is commonly referred to as stroboscopic photograph. When taking a stroboscopic photograph, one usual practice is to maintain the shutter of the camera open and to activate an electronic flash in a series of rapidly interrupted emissions. To this end, an electronic flash capable of producing interrupted emissions at a rapid rate is offered on the market and is referred to as an electronic flash of multiple emission type. However, such electronic flash of the prior art includes a plurality of main capacitors or a plurality of flash discharge tubes so that a series of flashlight emissions can be produced at a rapid rate. This results in an increased size and an increased cost of the arrangement.

To avoid such disadvantage of a conventional electronic flash of continued emission type or multiple emission type, it is desirable to provide a conventional electronic flash including a single main capacitor and a single flash discharge tube and in which the discharge tube can be activated over a continued emission interval or over a series of multiple emissions.

However, a trigger capacitor associated with a flash discharge tube is charged through a resistor in a conventional electronic flash, requiring a finite length of time to charge the capacitor. This limits the length of an interval between interrupted emissions from the discharge tube.

It will therefore be seen that it is difficult to charge a commutation capacitor rapidly, to provide a continued emission during a given time interval and at a given level, to achieve a rapid triggering operation or to produce a series of interrupted multiple emissions of flashlight at a high rate with a conventional electronic flash.

SUMMARY OF THE INVENTION

It is an object of the invention to provide a circuit for rapidly charging a commutation capacitor in which a switching element is connected in series with a commutating switching element across a power supply or a main capacitor and is rendered conductive simultaneously with a main switching element to form a rapid charging path for the commutation capacitor.

It is another object of the invention to provide a series controlled electronic flash of automatic emission control type including a charging switching element connected in series with a commutating switching element across a power supply or a main capacitor, and an activate signal is repeatedly applied to a main switching element, the commutating switching element and the charging switching element in a given sequence, thus allowing a flash discharge tube to produce a continued emission substantially at a given brightness level.

It is a further object of the invention to provide a trigger circuit in which a series combination of switching elements which are used to charge and discharge a trigger capacitor are connected across a power supply or a main capacitor and are rendered conductive alternately, thereby achieving a trigger operation by charging and discharging the trigger capacitor.

It is yet another object of the invention to provide a series controlled electronic flash of automatic emission control type including a charging switching element associated with a commutation capacitor and connected in series with a commutating switching element across a power supply or a main capacitor and in which switching elements which are used to charge and discharge a trigger capacitor are connected in series with each other across the power supply or main capacitor, and wherein an activate signal is repeatedly applied to the switching elements which charge and discharge the trigger capacitor, a main switching element, the commutating switching element and the switching element which is used to charge the commutation capacitor in a given sequence, thereby enabling a flash discharge tube to produce an interrupted series of multiple emissions at a high rate.

In accordance with the invention, a switching element which is used to charge a commutation capacitor is connected in series with a commutating switching element, and a main switching element and the switching element which is used to charge the commutation capacitor are rendered conductive simultaneously to charge the commutation capacitor. In this manner, the commutation capacitor can be charged in a very brief time.

Also in accordance with the invention, a main switching element and a commutating switching element are alternately turned on and off in a very brief period to cause a flash discharge tube to produce a continued emission substantially at a given level or to produce a series of multiple emissions. To this end, it is necessary that a charge must be stored across the commutation capacitor before a commutation operation takes place. Accordingly, the commutation circuit includes a separate switching element which enables the commutation capacitor to be rapidly charged.

In accordance with another aspect of the invention, a series circuit comprising a pair of switching elements which are used to charge and to discharge a trigger capacitor is provided. The pair of switching elements are rendered conductive in an alternate fashion to allow a flash discharge tube to be triggered. In this manner, it is possible to trigger the discharge tube with a very brief interval.

In accordance with a further aspect of the invention, the invention recognizes the fact that a flash discharge tube can be triggered not only by the discharge, but also by the charging of a trigger capacitor in order to trigger the discharge tube consecutively in a very brief interval to produce a series of multiple emissions. Accordingly, the trigger circuit includes a separate switching element through which the trigger capacitor is rapidly charged, thus enabling a rapid triggering of the discharge tube.

The invention avoids the need for a current limiting coil connected in series with a flash discharge tube, as disclosed in afore-mentioned Japanese Laid-Open Patent Application No. 129,327/1980, permitting an increased current flow through the discharge tube and thus allowing the latter to produce a continued emission at a high brightness level. A continued emission is achieved by the addition of a separate switching element which is used to charge a commutation capacitor, to a commutation circuit associated with a series controlled electronic flash of automatic emission control type of the prior art. In this manner, a continued emission is allowed with a simple and inexpensive arrangement, and the electronic flash can also be used as a normal automatic emission control type by merely operating a changeover switch.

In accordance with yet another aspect of the invention, a conventional series controlled electronic flash of automatic emission control type may be modified by adding a commutation capacitor charging switching element to a commutation circuit thereof and also adding a trigger capacitor charging switching element to a trigger circuit thereof, thereby enabling a multiple emission. The current flow during both the charging and the discharge of the trigger capacitor can be used to trigger a flash discharge tube, whereby a multiple emission therefrom is possible with a very brief time interval between successive emissions. This also achieves a highly efficient use of the charge on the trigger capacitor. A multiple emission is achieved with a simple and inexpensive arrangement, and the electronic flash can also be used as a normal automatic emission control type by a mere operation of a changeover switch.

DESCRIPTION OF PREFERRED EMBODIMENTS

Figure 2:
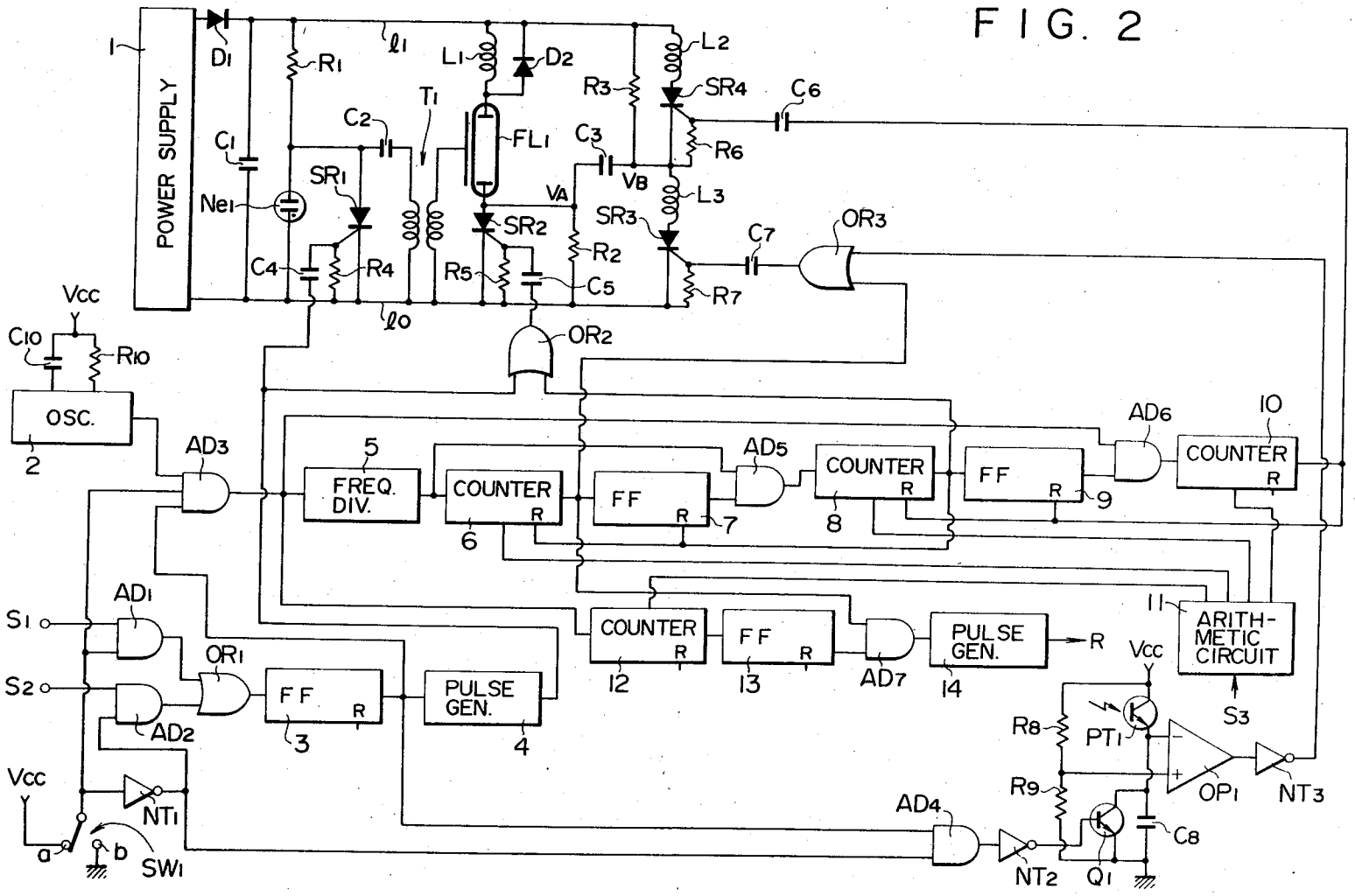
FIG. 2 is a circuit diagram of an electronic flash according to one embodiment of the invention which is capable of producing a continued emission.

Referring to FIG. 2, there is shown a circuit diagram of an electronic flash according to one embodiment of the invention which is capable of producing a continued emission. The electronic flash includes a trigger thyristor SR1 having its gate connected through a resistor R4 to a bus $l_0$ and also connected through a capacitor C4 to the output of a pulse generator 4 which will be described later. A main thyristor SR2 has its gate connected through a resistor R5 to the bus $l_0$ and also connected through a capacitor C5 to the output of an OR circuit OR2. A commutating thyristor SR3 has its gate connected through a resistor R7 to the bus $l_0$ and also connected through a capacitor C7 to the output of OR circuit OR3. A thyristor SR4 which is used to charge a commutation capacitor is connected in series with the commutating thyristor SR3 across the pair of buses $l_1$, $l_0$. Specifically, the thyristor SR4 has its anode connected through a coil L2 to the bus $l_1$ and its cathode connected through a coil L3 to the anode of the thyristor SR3. One end of a commutation capacitor C3 is connected through the coil L3 to the anode of the thyristor SR3. The purpose of the coils L2 and L3 is to adjust a charging and a discharge time constant of the commutation capacitor C3 through resistive components thereof. The gate of the thyristor SR4 is connected through a resistor R6 to the cathode thereof and is also connected through a capacitor C6 to the output of a counter 10 which will be described later.

The electronic flash of the present embodiment includes a mode changeover switch SW1 which permits selection between a continued emission mode and a normal synchronized emission mode. Specifically, the switch SW1 has a fixed terminal a for selection of the continued emission mode and to which an operating voltage Vcc is applied, and also has another fixed terminal b for selection of the synchronized emission mode and which is connected to the ground. A movable contact of the switch SW1 is connected to the input of NOT circuit NT1, to one input of AND circuit AD1 and to one input of a three input AND circuit AD3.

The output of NOT circuit NT1 is connected to one input of AND circuits AD2 and AD4. A synchronized emission trigger signal S2 which is output in synchronism with the full opening of a shutter, and supplied from the synchro contacts (not shown) of an associated camera, is applied to the other input of AND circuit AD2. A continued emission trigger signal S1 which is output from a single lens reflex camera in response to the beginning of an upward movement of a movable reflecting mirror (not shown) or to the initiation of a shutter operation is applied to the other input of AND circuit AD1. The outputs from AND circuits AD1 and AD2 are fed to OR circuit OR1, the output of which is fed to the input of a flipflop (hereafter abbreviated as "FF") 3. The output from FF3 is fed to a second input of AND circuit AD3, to the other input of AND circuit AD4 and to the input of a pulse generator 4. The pulse generator 4 functions to produce a positive one-shot pulse in response to the inversion of its input signal from "L" to its "H" level. (The same is also true with respect to other pulse generators.) The output of the pulse generator is connected through the capacitor C4 to the gate of the trigger thyristor SR1 and is also fed to one input of OR circuit OR2.

The third input of AND circuit AD3 is connected to the output of an oscillator 2, which operates to produce a pulse signal of a frequency which depends on the values of a capacitor C10 and a resistor R10 which have their one end connected to the oscillator 2 and their other end connected to the supply of an operating voltage Vcc. The output of AND circuit AD3 is fed to one input of AND circuit AD6, to the input of a frequency divider 5 and to the input of a counter 12. The output of the frequency divider 5 is fed to one input of AND circuit AD5 and to the input of a counter 6. The output of the counter 6 is fed to one input of OR circuit OR3, to the input of FF 7 and to one input of AND circuit AD7. The output of FF7 is fed to the other input of AND circuit AD5. The output of AND circuit AD5 is fed to the input of a counter 8, the output of which is fed to the other input of OR circuit OR2 and also to the input of FF9. The output from the counter 8 is also connected to the reset input R of the counter 6 and FF7. The output of FF9 is fed to the other input of AND circuit AD6, the output of which is in turn connected to the input of the counter 10. The output of the counter 10 is connected through the capacitor C6 to the gate of the thyristor SR4 and is also connected to the reset input R of both the counter 8 and FF9.

The output of the counter 12 is connected to the input of FF13, the output of which is in turn connected to the other input of the AND circuit AD7. The output of AND circuit AD7 is connected to the input of a pulse generator 14, the output of which is connected to the reset input R of each of the counters 6, 8, 10 and 12 and FF's 3, 7, 9 and 13.

The counters 6, 8, 10 and 12 are connected with an arithmetic circuit 11, which functions to deliver preset count signals to the counters 6, 8, 10 and 12, respectively, which are calculated on the basis of information S4 representing an exposure period, a film speed and a diaphragm aperture. When each of the counters 6, 8, 10 and 12 counts input pulses to the respective preset count, it produces a positive one-shot pulse.

The output of AND circuit AD4 is connected to the input of NOT circuit NT2, the output of which is in turn connected to the base of an NPN transistor Q1. The transistor Q1 has its collector and emitter connected to opposite ends of an integrating capacitor C8, with one end of the capacitor and the emitter being connected to the ground. The opposite end of the capacitor C8 is connected to an inverting input terminal of an operational amplifier OP1, which operates as a comparator, and is also connected to the emitter of a phototransistor PT1 which provides the photometry. The operating voltage Vcc is applied to the collector of the phototransistor PT1. The non-inverting input terminal of the amplifier OP1 is connected to the junction between resistors R8 and R9 which are connected in series between the supply of operating voltage Vcc and the ground. The output of the amplifier OP1 is connected to the input of NOT circuit NT3, the output of which is in turn connected to one input of OR circuit OR3. It will be understood that the resistors R8, R9, transistor Q1, phototransistor PT1, integrating capacitor C8 and amplifier OP1 form together a photometric circuit which is used for providing an automatic emission control.

Figure 1:
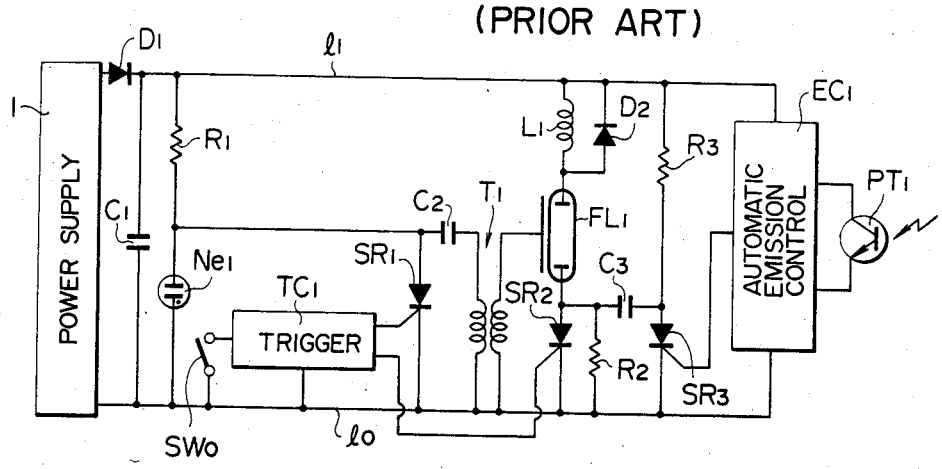
FIG. 1 (PRIOR ART)
FIG. 1 is a circuit diagram of an example of a conventional series controlled electronic flash of automatic emission control type.

It is to be understood that parts not specifically referred to are arranged and connected in a manner similar to those shown in the electronic flash of FIG. 1, and hence are designated by like reference characters without repeating their description. For brevity of description, parts or circuit portions once described will be designated by like reference characters to avoid their repeated description.

Figure 3:
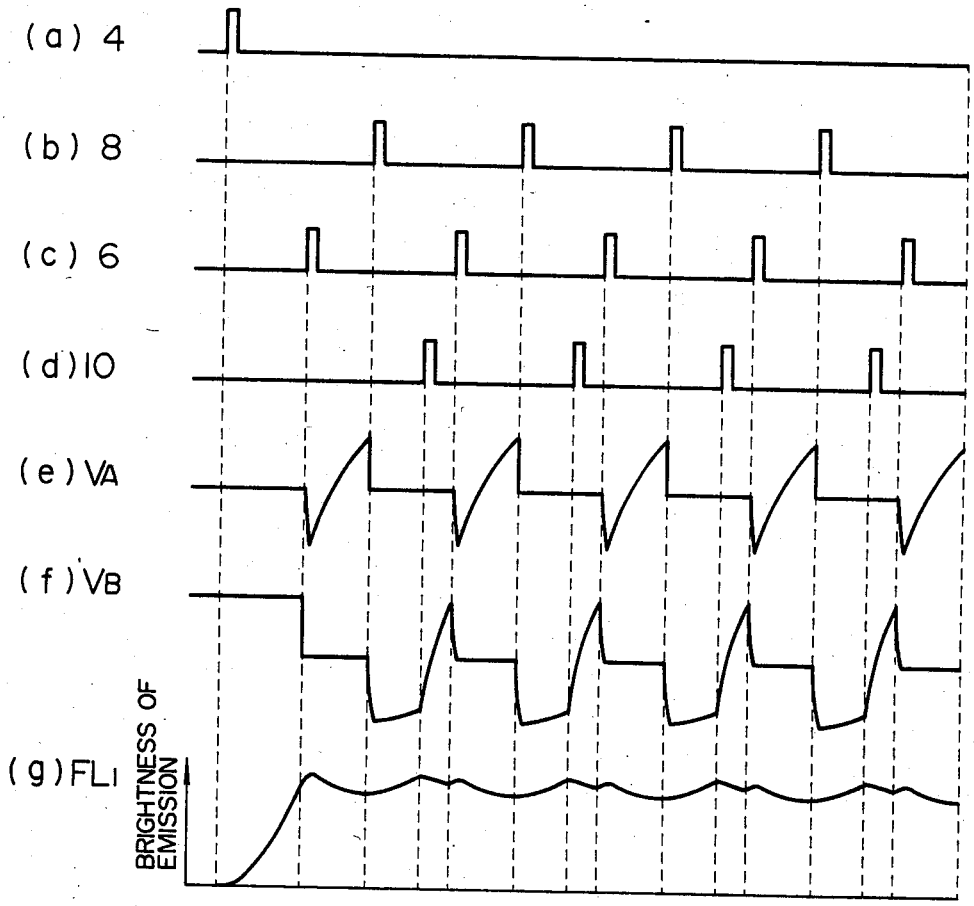
FIGS. 3(*a*) to (*g*) are a series of timing charts which illustrate changes occurring in various outputs from certain points within the electronic flash shown in FIG. 2.

In operation, it is initially assumed that the mode changeover switch SW1 is thrown to its fixed contact a to select the continued emission mode. In this instance, the "H" level applied to the other input of AND circuit AD1 enables this gate, so that the continued emission trigger signal S1 supplied from the camera passes therethrough and also passes through OR circuit OR1 to be fed to FF3. FF3 is then set, inverting its output to its "H" level. Referring to FIG. 3(*a*), it will be seen that the pulse generator 4 then produces a positive one-shot pulse, which is fed through the capacitor C4 to fire the trigger thyristor SR1. When the trigger thyristor SR1 is fired, the capacitor C2 is short-circuited therethrough, causing a discharge current to pass through the primary coil of the trigger transformer T1. This induces a high voltage across the secondary coil, which is applied to the trigger electrode to excite flash discharge tube FL1. At the same time, the one-shot pulse from the pulse generator 4 is also fed through OR circuit OR2 and the capacitor C5 to fire the main thyristor SR2. When the main thyristor SR2 is fired, the main capacitor C1 discharges through coil L1, the excited discharge tube FL1 and the main thyristor SR2, whereby the discharge tube FL1 initiates the emission of flashlight, as indicated in FIG. 3(*g*).

On the other hand, when the output of FF3 inverts to its "H" level, the gate AD3 is enabled, whereby the pulse from the oscillator 2 is fed to AND circuit AD6, the frequency divider 5 and the counter 12. The frequency divider 5 functions to effect a frequency division of pulses applied to deliver a count pulse to AND circuit AD5 and the counter 6, which then counts such count pulse. It will be noted that when the counter 6 counts up a preset count which is predetermined by the arithmetic circuit 11, or in other words, when a given time length passes since the continued emission trigger signal S1 is applied, the counter delivers a positive pulse, as indicated in FIG. 3(*c*). This positive pulse is fed through OR circuit OR3 and the capacitor C7 to fire the thyristor SR3, whereupon the commutation capacitor C3 discharges through the thyristor SR3 to reverse bias the main thyristor SR2, thus turning the latter off. While the main thyristor SR2 becomes non-conductive, the charging current to the commutation capacitor C3 flows through the discharge tube FL1, the capacitor C3 and the thyristor SR3, so that the discharge tube FL1 continues its emission while gradually lowering its brightness level, as indicated in FIG. 3(*g*). Accordingly, the voltage $V_A$ at one end of the commutation capacitor C3 initially decreases and then rapidly rises, as indicated in FIG. 3(*e*). The voltage $V_B$ at the other end of the commutation capacitor C3 assumes a zero potential, as indicated in FIG. 3(*f*).

The positive pulse output from the counter 6 sets FF7, and its output of "H" level enables AND circuit AD5. Accordingly, count pulses from the frequency divider 5 pass through AND circuit AD5 to be fed to the counter 8, which then begins counting. When it has counted a given number of pulses which is determined by the preset count signal from the arithmetic circuit 11, the counter 8 delivers a positive pulse, as indicated in FIG. 3(*b*). This positive pulse is fed through OR circuit OR2 and the capacitor C5 to re-fire the main thyristor SR2. Accordingly, the current flow through a path including the discharge tube FL1, commutation capacitor C3 and thyristor SR3 is diverted to a path including the discharge tube FL1 and the main thyristor SR2, while causing the charge on the commutation capacitor C3 to reversely bias the thyristor SR3, thus turning the latter off. As a consequence, the brightness level of the emission from the discharge tube FL1 begins to rise again, as indicated in FIG. 3(*g*).

The positive pulse output from the counter 8 sets FF9, and its output inverts to its "H" level, thus enabling AND circuit AD6. Thereupon the counter 10 begins counting oscillation pulses from the oscillator 2 which are fed through AND circuits AD3 and AD6. Simultaneously, both the counter 6 and FF7 are reset while AND circuit AD5 is disabled. When the counter 10 has counted a given number of pulses which is predetermined by the preset count signal from the arithmetic circuit 11, it delivers a positive pulse, as indicated in FIG. 3(*d*). This positive pulse is fed through the capacitor C6 to fire the thyristor SR4. Accordingly, there occurs a charging current of the opposite polarity which flows through the commutation capacitor C3 through a path including the coil L2, thyristor SR4, commutation capacitor C3 and thyristor SR2. In this manner, the commutation capacitor C3 is charged within a very brief time interval, as indicated in FIG. 3(*f*). Part of the discharge current is bypassed through the thyristor SR4 and other components, with result that the brightness level of the emission of the discharge tube FL1 slightly declines, as indicated in FIG. 3(*g*). When the charging of the commutation capacitor C3 is completed, the current flow through the thyristor SR4 reduces below its holding current level and thus the latter becomes turned off. At the same time, the positive pulse output from the counter 10 resets both the counter 8 and FF9 and also disables AND circuit AD6.

Subsequently the counter 6 again counts up to a preset count, and delivers a positive pulse, as indicated in FIG. 3(*c*). Subsequently, the counters 6, 8 and 10 sequentially deliver a positive pulse, as indicated in FIG. 3(*c*), (*b*) and (*d*), respectively, in the manner mentioned above, thus sequentially firing the thyristors SR3, SR2 and SR4. The brightness level of the emission from the discharge tube FL1 then repeatedly decreases and rises (see FIG. 3(*g*)). It is to be understood that the period in which a change in the brightness level of the emission repeats itself is short enough, in comparison to an exposure period, to allow the discharge tube FL1 to be regarded as continuing the emission at substantially constant brightness level.

On the other hand, after FF3 is set, the counter 12 receives oscillation pulses from the oscillator 2 through AND circuit AD3, thus commencing the determination of the duration of the continued emission. When the counter 12 counts up to a given value determined by the preset count signal supplied from the arithmetic circuit 11, it delivers a positive pulse, which then sets FF13. FF13 then produces an output of "H" level, which enables AND circuit AD7. Hence, when the counter 6 subsequently delivers a positive pulse, the latter passes through AND circuit AD7 to be applied to the pulse generator 14, which then produces a reset signal R. The reset signal R is applied to FF's 3, 7, 9 and 13 and the counters 6, 8, 10 and 12, thus resetting these components. Accordingly, the electronic flash of the present embodiment ceases its operation and the continued emission from the discharge tube FL1 terminates, with the thyristor SR3 being turned on or with the commutation being interrupted.

It is to be understood that during the continued emission mode, since the mode switch SW1 is thrown to its fixed terminal a, AND circuit AD2 receives "L" level at its one input and thus is disabled. Accordingly, if a synchronized emission trigger signal S2 is supplied from the camera, the circuit portion which follows FF3 is not influenced in any manner whatsoever. One input of AND circuit AD4 also receives "L" level, and this gate is also disabled, assuring that the transistor Q1 is turned on, thus eliminating the likelihood that an emission control signal may be output from the photometric circuit.

When the mode switch SW1 is thrown to its fixed contact b to select the synchronized emission mode, it will be seen that in the electronic flash of the present embodiment, one input of AND circuit AD1 receives "L" level, whereby this gate is disabled and inhibits any response to the continued emission trigger signal S1 applied thereto. On the other hand, one input of AND circuit AD2 receives "H" level, and thus this gate is enabled to be responsive to the synchronized emission trigger signal S2. Thus, the synchronized emission trigger signal S2 supplied from the camera causes AND circuit AD2 to produce an output of "H" level, which is fed through OR circuit OR1 to set FF3. This activates the pulse generator 4, the output pulse of which fires the trigger thyristor SR1 and simultaneously fires the main thyristor SR2. Thus, the main capacitor C1 discharges through the discharge tube FL1 and the main thyristor SR2, whereby the emission of flashlight from the discharge tube FL1 is initiated.

When FF3 is set, AND circuit AD4 which already receives "H" level at its one input as a result of the switch SW1 being thrown to the fixed terminal b, also receives an "H" level at its other input, and its output is fed through NOT circuit NT2 to supply "L" level to the base of the transistor Q1, which is therefore turned off. Accordingly, a photocurrent produced by the phototransistor PT1 is integrated by the capacitor C8, and the photometric circuit begins its photometric operation. It should be noted that when FF3 is set, AND circuit AD3 receives "H" level at one of its three inputs, but since another input receives the "L" level as a result of the switch SW1 being thrown to the fixed terminal b, this gate cannot be enabled to transmit oscillation pulses from the oscillator 2 to the circuit portion following the frequency divider 5. Stated differently, the circuit portion which is responsive to the continued emission signal does not operate.

Considering the photometric circuit, when the voltage across the integrating capacitor C8 exceeds a reference voltage defined by the potential at the junction between resistors R8 and R9, the output of the amplifier OP1 inverts and is fed through NOT circuit NT3, OR circuit OR3 and capacitor C7 to fire the thyristor SR3. This causes the commutation capacitor C3 to discharge through the thyristor SR3, thus reversely biasing and turning off the main thyristor SR2. Accordingly, the discharge current passing through the discharge tube FL1 is diverted to a path including the commutation capacitor C3 and the thyristor SR3, and the discharge tube FL1 terminates its synchronized emission at a point in time when the commutation capacitor C3 is oppositely charged until the voltage applied thereto reduces below an extinction level. It will be seen therefore that the electronic flash of the present embodiment, being capable of producing a continued emission, functions as a normal electronic flash of automatic emission control type whenever the mode switch SW1 is thrown to its fixed contact b. It will be noted that during the synchronized emission mode, FF3 is reset by an emission control signal output from the photometric circuit, through a path not shown.

Figure 4:
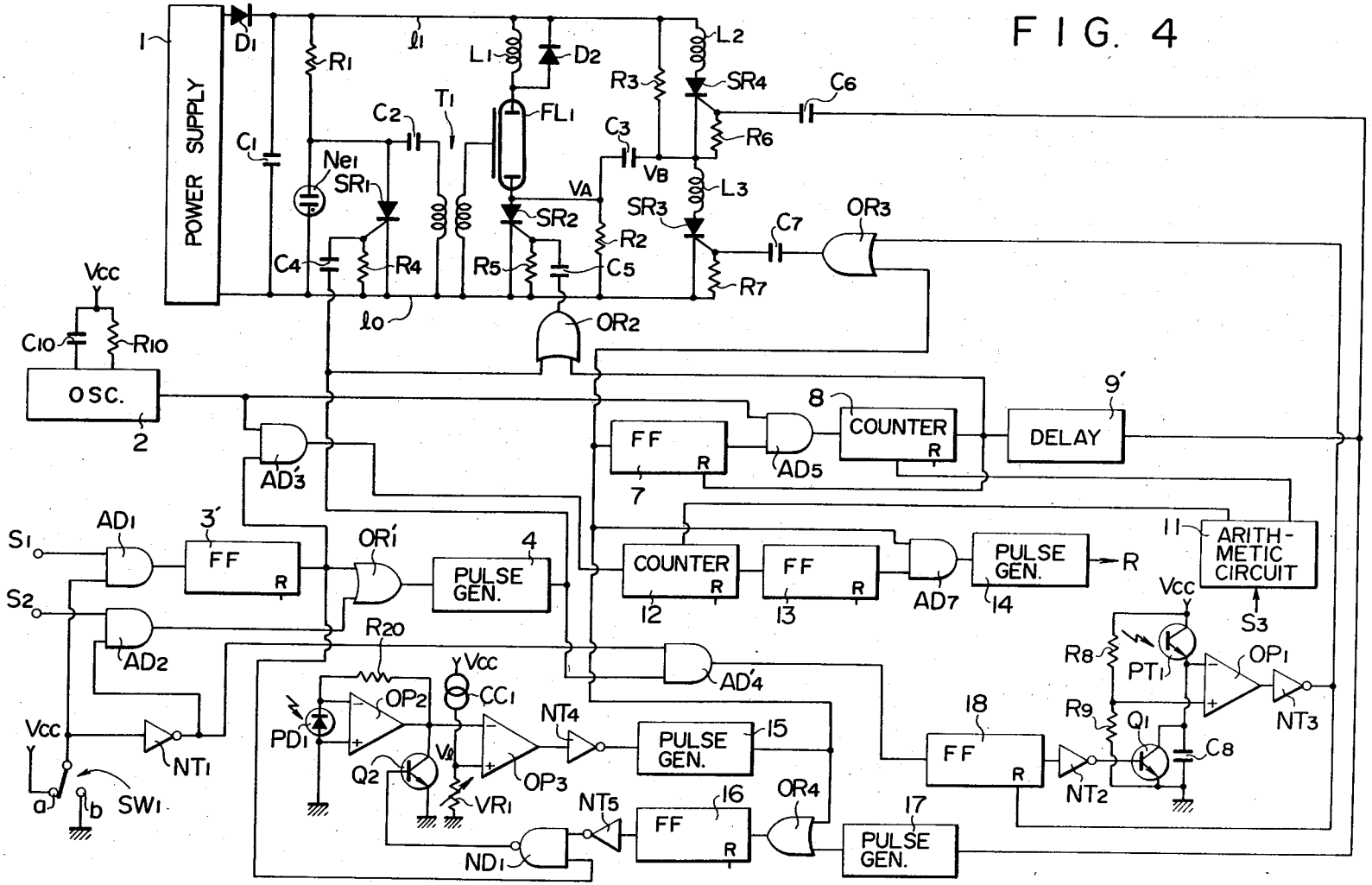
FIG. 4 is a circuit diagram of an electronic flash according to another embodiment of the invention which is capable of producing a continued emission.

FIG. 4 shows the electrical circuit of an electronic flash according to another embodiment of the invention which is capable of producing a continued emission. This electronic flash includes a brightness detector having a photodiode PD1 located adjacent to the flash discharge tube FL1. The purpose of the brightness detector is to detect the brightness level of the emission from the discharge tube FL1 and to control the electronic flash so as to maintain the brightness at a substantially constant level. Specifically, the photodiode PD1 is located adjacent to the discharge tube FL1, and has its anode connected to the non-inverting input and its cathode connected to the inverting input of an operational amplifier OP2. The non-inverting input of the amplifier OP2 is connected to the ground while the inverting input is connected through a resistor R20 to the output of the amplifier. The output of the amplifier OP2 is connected to the inverting input of an operational amplifier OP3, which functions as a comparator, and is also connected to the collector of an NPN transistor Q2, which has its emitter connected to the ground and which has its base connected to the output of NAND circuit ND1. The non-inverting input of the amplifier OP3 is connected to the junction between a constant current circuit CC1 and a variable resistor VR1 which provides an adjustable reference voltage. At its other end, the constant current source CC1 is connected to the supply of the operating voltage Vcc while the other end of the variable resistor VR1 is connected to the ground. The variable resistor VR1 is preset with a resistance which is based on a shutter speed, a diaphragm aperture and film information. The combination of the photodiode PD1, amplifiers OP2 and OP3, resistor R20, transistor Q2, variable resistor VR1 and constant current circuit CC1 forms the brightness detector.

The output of the amplifier OP3, which represents the output of the brightness detector, is connected through NOT circuit NT4 to the input of a pulse generator 15, the output of which is connected to one input of OR circuit OR3, to the input of FF7, to one input of AND circuit AD7 and to one input of OR circuit OR4. The output of FF7 is connected to one input of AND circuit AD5 in the same manner as in the electronic flash shown in FIG. 2, but the other input of AND circuit AD5 is directly connected to the output of the oscillator 2. The output of AND circuit AD5 is connected to the input of the counter 8, the output of which is in turn connected to the other input of OR circuit OR2 and is also connected to the input of a delay circuit 9'. The output of the counter 8 is also connected to the reset terminal R of FF7. The output of the delay circuit 9' is connected through the capacitor C6 to the gate of the thyristor SR4 and is also connected to the input of a pulse generator 17.

The output of the pulse generator 17 is connected to the other input of OR circuit OR4, the output of which is connected to the input of FF16 which is sequentially set and reset in response to the inversion of an input signal thereto from its "L" to its "H" level. The output of FF16 is connected through NOT circuit NT5 to one input of NAND circuit ND1, the other input of which is connected to the output of FF3'. The input of FF3' is connected to the output of AND circuit AD1 while the output of FF3' is connected to one input of AND circuit AD'3 and to one input of OR circuit OR'1. The other input of AND circuit AD'3 is connected to the output of the oscillator 2 while the other input of OR circuit OR'1 is connected to the output of AND circuit AD2. The output of AND circuit AD'3 is connected to the input of the counter 12 while the output of OR circuit OR'1 is connected to the input of the pulse generator 4. The output of the pulse generator 4 is connected through the capacitor C4 to the gate of the trigger thyristor SR1, connected through OR circuit OR2 and the capacitor C5 to the gate of the main thyristor SR2, and also connected to one input of AND circuit AD'4. The other input of AND circuit AD'4 is connected to the output of NOT circuit NT1. The output of AND circuit AD'4 is connected to the input of FF18, the output of which is connected to the input of NOT circuit NT2. The output of NOT circuit NT3, which is connected to the output of the photometric circuit, is connected to one input of OR circuit OR3 and is also connected to the reset input R of FF18.

As in the electronic flash shown in FIG. 2, the counter 12 is sequentially followed by FF13, AND circuit AD7 and pulse generator 14. The output of the pulse generator 14 is connected to the reset input R of FF's 3', 7, 13 and 16 and the counters 8, 12. It should be understood that the counters 8 and 12 are supplied with preset count signals from the arithmetic circuit 11 mentioned above.

In operation, initially assuming that the mode switch SW1 is thrown to its fixed terminal a to select the continued emission mode, one input of AND circuit AD1 receives "H" level while one input of AND circuit AD2 receives "L" level, thus making the arrangement responsive to the continued emission trigger signal S1 and non-responsive to the synchronized emission trigger signal S2 supplied from the camera.

Figure 5:
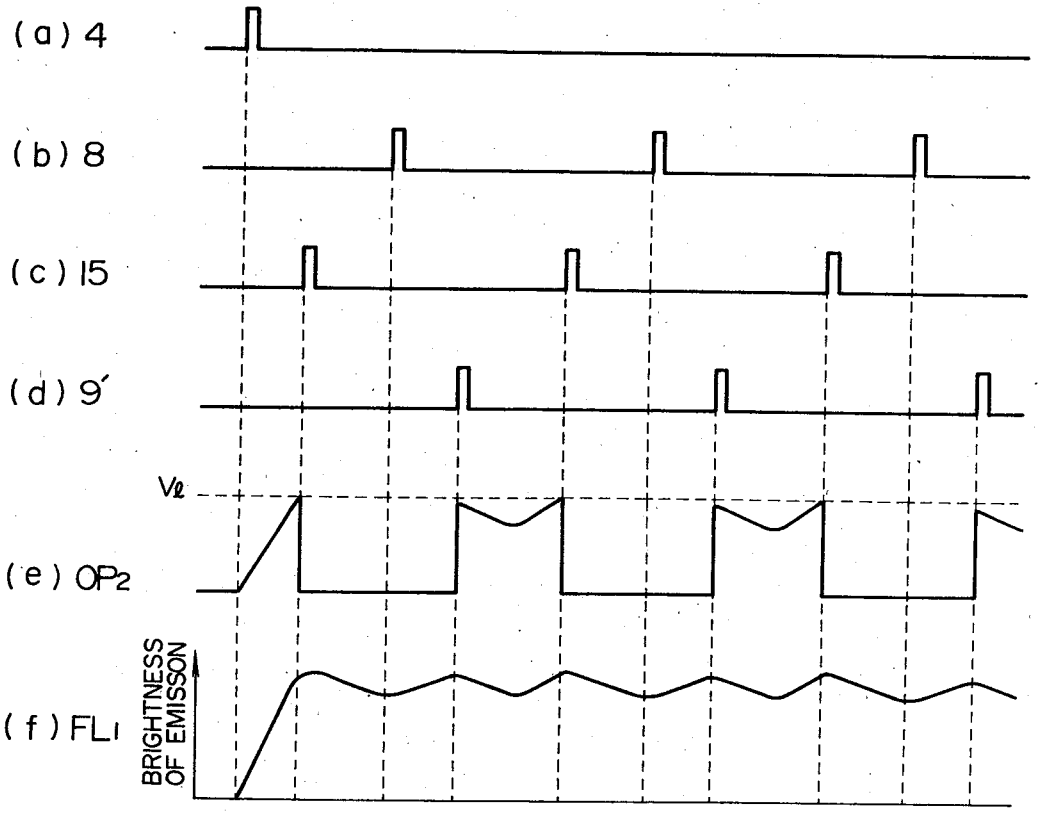
FIGS. 5(*a*) to (*f*) are a series of timing charts which illustrate changes occurring in various outputs from certain points in the electronic flash shown in FIG. 4.

Upon application of the continued emission trigger signal S1, AND circuit AD1 develops the continued emission trigger signal S1 at its output, which sets FF3'. When set, FF3' develops an output of "H" level, which enables AND gate AD'3, allowing oscillation pulses from the oscillator 2 to pass therethrough and be fed to the counter 12. The counter 12 thus begins counting the duration of the continued emission. Also, OR circuit OR'1 applies a signal of "H" level to the pulse generator 4, which therefore delivers a positive pulse, as indicated in FIG. 5(*a*), which is passed through the capacitor C4 to fire the trigger thyristor SR1, and which is also fed through OR circuit OR2 and the capacitor C5 to fire the main thyristor SR2. Accordingly, the flash discharge tube FL1 initiates the emission of flashlight, as indicated in FIG. 5(*f*). Additionally, one input of NAND circuit ND1 receives "H" level, whereby this gate is enabled. It produces an output of "L" level, which turns the transistor Q2 off. As a consequence, a voltage developed at the output of the amplifier OP2 and which is dependent on the brightness of the emission from the discharge tube FL1 is applied to the inverting input of the amplifier OP3, allowing the brightness detector to begin its operation.

After the initiation of emission from the discharge tube FL1, when the output voltage from the amplifier OP2 in the brightness detector reaches a reference voltage $V_1$ which corresponds to a predetermined brightness level, the output of the amplifier OP3 inverts, whereby the pulse generator 15 delivers a positive pulse at its output, as indicated in FIG. 5(*c*). This pulse is fed through OR circuit OR3 and the capacitor C7 to fire the thyristor SR3. Thereupon, the commutation capacitor C3 discharges to reverse bias the main thyristor SR2, thus turning it off. Accordingly, the discharge current through the discharge tube FL1 is diverted to a path including the commutation capacitor C3 and the thyristor SR3, and the brightness level of the emission from the discharge tube FL1 decreases in a gradual manner, as indicated in FIG. 5(*f*). The positive pulse delivered by the pulse generator 15 is also fed through OR circuit OR4 to set FF16, which produces an output of "H" level. This output is fed through NOT circuit NT5 and NAND circuit ND1 to turn the transistor Q2 on, thus ceasing the operation of the brightness detector, as indicated in FIG. 5(*e*). The positive pulse delivered by the pulse generator 15 also sets FF7, an output of "H" level of which enables AND circuit AD5, allowing oscillation pulses from the oscillator 2 to be fed to the counter 8. Thus, the counter 8 begins its counting operation until a given value, established by the preset count signal fed from the arithmetic circuit 11, is reached.

When the counter 8 counts up to the given count, it delivers a positive pulse, as indicated in FIG. 5(*b*). This positive pulse is fed through OR circuit OR2 and the capacitor C5 to re-fire the main thyristor SR2, whereby the discharge current through the discharge tube FL1 again passes through the main thyristor SR2. Accordingly, the charge on the commutation capacitor C3 reversely biases the thyristor SR3, which is then turned off. Also the brightness of the emission from the discharge tube FL1 changes into a rising direction as shown in FIG. 5(*f*). At the same time, the positive pulse delivered by the counter 8 resets FF7 and thus disables AND circuit AD5.

The positive output pulse from the counter 8 activates the delay line 9', which delivers a positive pulse as indicated in FIG. 5(*d*) after a given delay. This output is fed through the capacitor C6 to fire the thyristor SR4, whereby part of the discharge current through the discharge tube FL1 is bypassed to a path including the thyristor SR4 and the commutation capacitor C3, thus causing the brightness of the emission from the discharge tube FL1 to again change into a declining direction, as indicated in FIG. 5(*f*). On the other hand, the positive output pulse from the delay circuit 9' also causes a positive pulse to be developed simultaneously at the output of a pulse generator 17, which pulse is fed through OR circuit OR4 to the input of FF16. Accordingly, FF16 which is already set is reset, with its output inverting to its "L" level, which output is fed through NOT circuit NT5 and NAND circuit ND1 to be applied to the base of the transistor Q2, thus turning it off. Consequently, the brightness detector again begins to operate, as indicated in FIG. 5(*e*).

When the commutation capacitor C3 is charged by a current flow through a path including the thyristor SR4, commutation capacitor C3 and main thyristor SR2, the current flow through the thyristor SR4 reduces below its holding current level and is turned off. As a result, the current which has been bypassed through the path including the thyristor SR4 and the commutation capacitor C3 again passes through the discharge tube FL1, and accordingly the brightness of the emission from the latter again increases, as indicated in FIG. 5(*f*).

When the output voltage from the amplifier OP2 in the brightness detector again reaches the reference voltage $V_l$, as shown in FIG. 5(*e*), the pulse generator 15 delivers a positive pulse, as shown in FIG. 5(*c*). Subsequently, the brightness of the emission repeatedly declines and rises in a similar manner to that mentioned above, and the discharge tube FL1 continues the emission at substantially constant brightness level, as indicated in FIG. 5(*f*).

It will be appreciated that rather than controlling the brightness level of the emission at a time interval as performed by the electronic flash shown in FIG. 2, the present embodiment includes the brightness detector which directly detects the brightness of the emission from the discharge tube FL1 and controls the latter accordingly, thus resulting in an advantage that the brightness level of the emission can be maintained more accurately uniform as compared with the electronic flash shown in FIG. 2.

When the counter 12 counts up to the preset count, it delivers an output pulse which sets FF13 to enable AND circuit AD7, allowing the output from the pulse generator 15 to be fed to the pulse generator 14. Consequently, when the brightness detector subsequently detects the fact that the brightness of the emission from the discharge tube FL1 has reached a given level and the pulse generator 15 delivers a positive pulse, the pulse is fed through OR circuit OR3 and the capacitor C7 to fire the thyristor SR3, and is also fed through AND circuit AD7 to activate the pulse generator 14, which then delivers a positive reset signal R. The reset signal R is applied to FF's 3', 7, 13 and 16 and the counters 8 and 12 at their reset input R, thus resetting these components. Therefore, the electronic flash of the present embodiment terminates the continued emission from the discharge tube FL1 with the thyristor SR3 being on or upon cessation of the commutating operation.

When the mode switch SW1 is thrown to its fixed terminal b to select the synchronized emission mode, one input of AND circuit AD1 receives "L" level and one input of AND circuit AD2 receives "H" level, thus making the arrangement non-responsive to the continued emission trigger signal S1 and responsive to the synchronized emission trigger signal S2 supplied from the camera. When the synchronized emission trigger signal S2 is supplied from the camera, AND circuit AD2 delivers an output of "H" level, which is fed through OR circuit OR1' to activate the pulse generator 4, which then delivers a positive pulse. The positive pulse is fed through the capacitor C4 to fire the trigger thyristor SR1, and is also fed through OR circuit OR2 and the capacitor C5 to fire the main thyristor SR2. Accordingly, the main capacitor C1 discharges through the discharge tube FL1 and the main thyristor SR2, whereby the discharge tube FL1 initiates the emission of flashlight.

At the same time, the positive output pulse delivered by the pulse generator 4 is applied through AND circuit AD4' to FF18, thus setting the latter. FF18 delivers a positive output, which is applied through NOT circuit NT2 to the base of the transistor Q1, thus turning it off. Hence, the photometric circuit Which is provided for purpose of automatic emission control initiates photometry. When the voltage across the integrating capacitor C8 exceeds a reference voltage prevailing at the junction between the resistors R8 and R9, the output from the amplifier OP1 is inverted, and this output is fed through NOT circuit NT3, OR circuit OR3 and the capacitor C7 to fire the thyristor SR3. Accordingly, the discharge tube FL1 has its emission brightness reduced, and ceases the synchronized emission when the voltage thereacross reduces below a discharge extinction voltage. The output from NOT circuit NT3 is applied to the reset input R of FF18, thus resetting it. It will be seen therefore that the electronic flash of the present embodiment which is capable of producing a continued emission is also capable of functioning as an electronic flash of automatic emission control type whenever the mode switch SW1 is thrown to its fixed terminal b.

Figure 6:
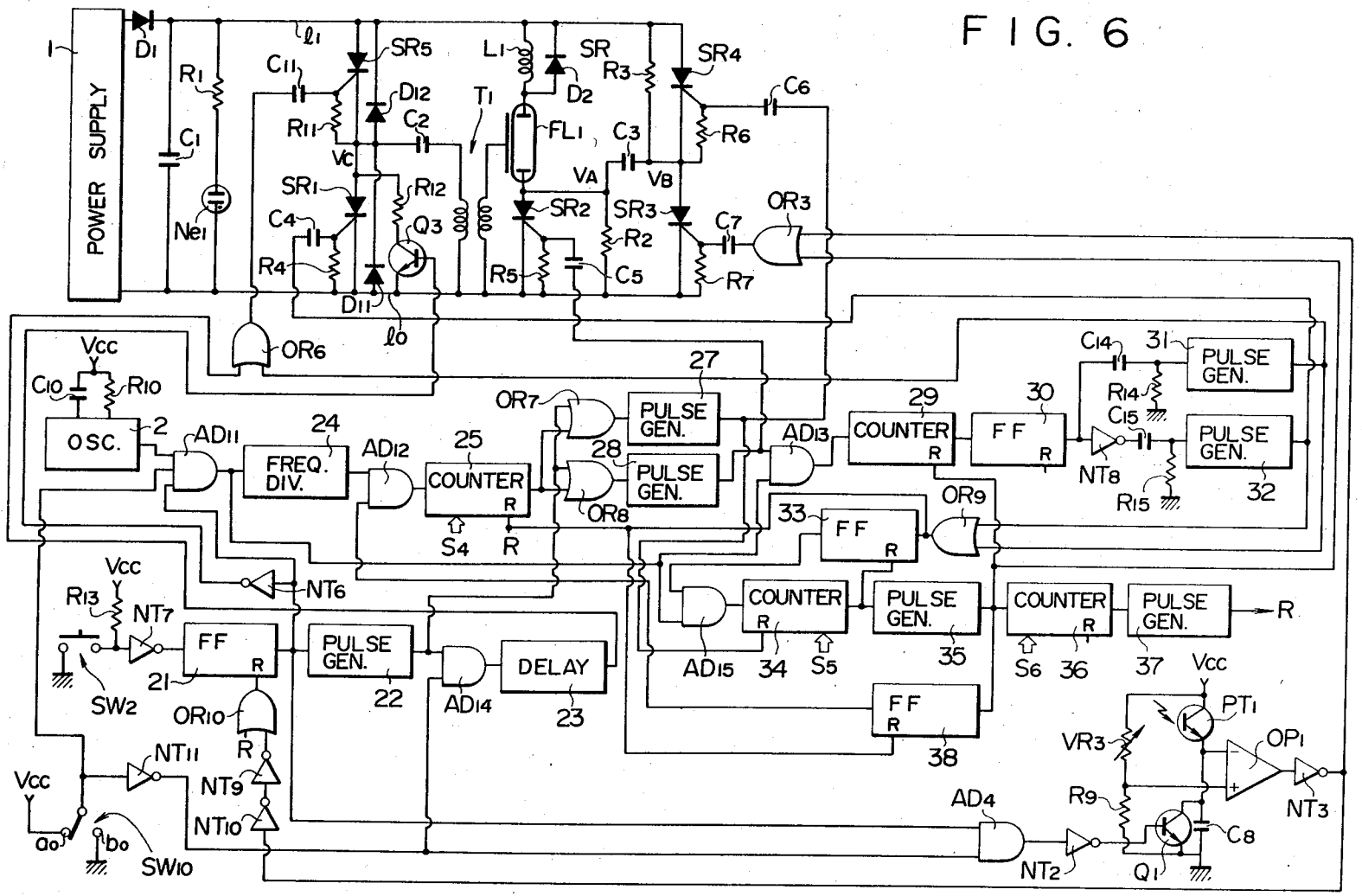
FIG. 6 is a circuit diagram of an electronic flash according to a further embodiment of the invention which is capable of producing a multiple emission.

FIG. 6 shows the electrical circuit of an electronic flash according to a further embodiment of the invention which is capable of providing a multiple emission. In this electronic flash, the anode of the trigger thyristor SR1 is connected to the cathode of a separate trigger thyristor SR5 rather than being connected to the junction between the resistor R1 and the neon lamp Ne1. The trigger thyristor SR1 is shunted by a series combination of a resistor R12 and an NPN transistor Q3. The separate trigger thyristor SR5 has its anode connected to the bus $l_1$ and its cathode connected to the anode of the trigger thyristor SR1. The gate of the thyristor SR5 is connected through a resistor R11 to the cathode thereof and is also connected through a capacitor C11 to the output of OR circuit OR6. The transistor Q3 has its collector connected through a resistor R12 to the anode of the trigger thyristor SR1 and its emitter connected to the bus $l_0$. The base of the transistor Q3 is connected through NOT circuit NT6 to the output of a flipflop 21. It will be noted that both the thyristor SR1 and the thyristor SR5 are shunted by diodes D11 and D12, respectively, which are poled oppositely to the respective thyristors.

The electronic flash of this embodiment includes synchro contacts SW2 which are located within the camera. The synchro contacts SW2 have one end connected to the ground and the other end connected through a resistor R13 to the supply of the operating voltage Vcc and also connected to the input of NOT circuit NT7. The output of the NOT circuit NT7 is connected to the input of FF21, the output of which is in turn connected to one input of a three input AND circuit AD11, to the input of NOT circuit NT6, to the input of a pulse generator 22 and to one input of AND circuit AD4.

The output of the pulse generator 22 is connected to one input of each of OR circuits OR7 and OR8, and is also connected to one input of AND circuit AD14. The other input of AND circuit AD14 is connected through NOT circuit NT11 to the movable contact of a mode changeover switch SW10. The mode switch SW10 permits a selection between a multiple emission mode and the normal synchronized emission mode. Specifically, it has a fixed terminal $a_0$ for selection of the multiple emission mode which is connected to the supply of the operating voltage Vcc and another fixed terminal $b_0$ for selection of the synchronized emission mode which is connected to the ground. The movable contact of the switch SW10 is connected to another input of AND circuit AD11 and is also connected through NOT circuit NT11 to the other input of AND circuit AD14 and to the other input of AND circuit AD4. The output of the AND circuit AD14 is connected to the input of a delay circuit 23, the output of which is connected to one input of OR circuit OR6.

A third input of AND circuit AD11 is connected to the output of the oscillator 2, and the output of AND circuit AD11 is connected to the input of a frequency divider 24, to one input of AND circuit AD13 and to one input of AND circuit AD15. The output of the frequency divider 24 is connected to one input of AND circuit AD12, the other input of which is connected to the output of FF38 while the output of AND circuit AD12 is connected to the input of a counter 25. The counter 25 is supplied with a preset count signal S4 which establishes a time interval between successive emissions of a multiple emission. It delivers a positive one-shot pulse when it has counted up to this preset count.

The output of the counter 25 is connected to the other input of each of the OR circuits OR7 and OR8. The output of OR circuit OR7 is connected to the input of a pulse generator 27 while the output of OR circuit OR8 is connected to the input of a pulse generator 28. The output of the pulse generator 27 is connected through the capacitor C6 to the gate of the thyristor SR4 and is also connected to the reset input R of a counter 34. The output of the pulse generator 28 is connected through the capacitor C5 to the gate of the main thyristor SR2 and is also connected to the other input of AND circuit AD13. The output of AND circuit AD13 is connected to the input of a counter 29, the output of which is connected to the input of FF30. The output of FF30 is connected to one end of a capacitor C14 and is also connected through NOT circuit NT8 to one end of a capacitor C15. The other end of the capacitor C14 is connected to the ground through a resistor R14 and is also connected to the input of a pulse generator 31. The other end of the capacitor C15 is connected to the ground through a resistor R15 and is also connected to the input of a pulse generator 32. The output of the pulse generator 31 is connected to the other input of OR circuit OR6 and also to one input of OR circuit OR9. The output of the pulse generator 32 is connected through the capacitor C4 to the gate of the trigger thyristor SR1 and also connected to the other input of OR circuit OR9.

The output of OR circuit OR9 is connected to the reset input R of the counter 25 and to the reset input R of FF38, and also connected to the input of FF33. The output of FF33 is connected to the other input of AND circuit AD15, the output of which is connected to the input of a counter 34. The counter 34 is supplied with a preset count signal S5 which establishes the duration of each flashlight emission during a multiple emission (guide number). The counter 34 delivers a positive one-shot pulse when it has counted up to the preset count. The output of the counter 34 is connected to the reset input R of FF33 and also to the input of a pulse generator 35.

The output of the pulse generator 35 is connected to the reset input R of the counter 29, to the other input of OR circuit OR3, to the input of a counter 36 and to the input of FF38. The counter 36 is supplied with a preset count signal S6 which establishes the number of emissions to be used during a multiple emission. The counter 36 delivers a positive one-shot pulse when it has counted up to the preset count. The output of the counter 36 is connected to the input of a pulse generator 37, the output of which delivers a reset signal R which causes the multiple emission to be terminated. The reset signal R is applied to the reset input R of the counters 25 and 36 as well as FF30, and is also applied to one input of OR circuit OR10 so as to be applied therethrough to the reset input R of FF21.

It will be noted that in the photometric circuit which is used for purpose of automatic emission control, the resistor R8 shown in FIGS. 2 and 4 is replaced by a variable resistor VR3 in order to permit an emission control level to be adjusted. The output of NOT circuit NT3, which represents the output of the photometric circuit, is connected to one input of OR circuit OR3 and is also connected through NOT circuits NT10 and NT9 in series to the other input of OR circuit OR10.

It should be noted that in the electronic flash of the present embodiment, the coils L2 and L3 which are connected with the anode of the thyristors SR4 and SR3, respectively, as shown in FIGS. 2 and 4, are not provided. The reason for this is that for a multiple emission, the charging and discharge time of the commutation capacitor C3 must be reduced as compared with that used during the continued emission.

In operation, it is initially assumed that the mode switch SW10 is thrown to its fixed terminal $a_0$ to select the multiple emission mode. Then, one input of AND circuit AD11 receives the "H" level, which is fed through NOT circuit NT11 to produce an "L" level at the other input of AND circuit AD14 and at the other input of AND circuit AD4. Accordingly, AND circuit AD14 is disabled to deactivate the delay circuit 23, and AND circuit AD4 is disabled to deactivate the photometric circuit.

Figure 7:
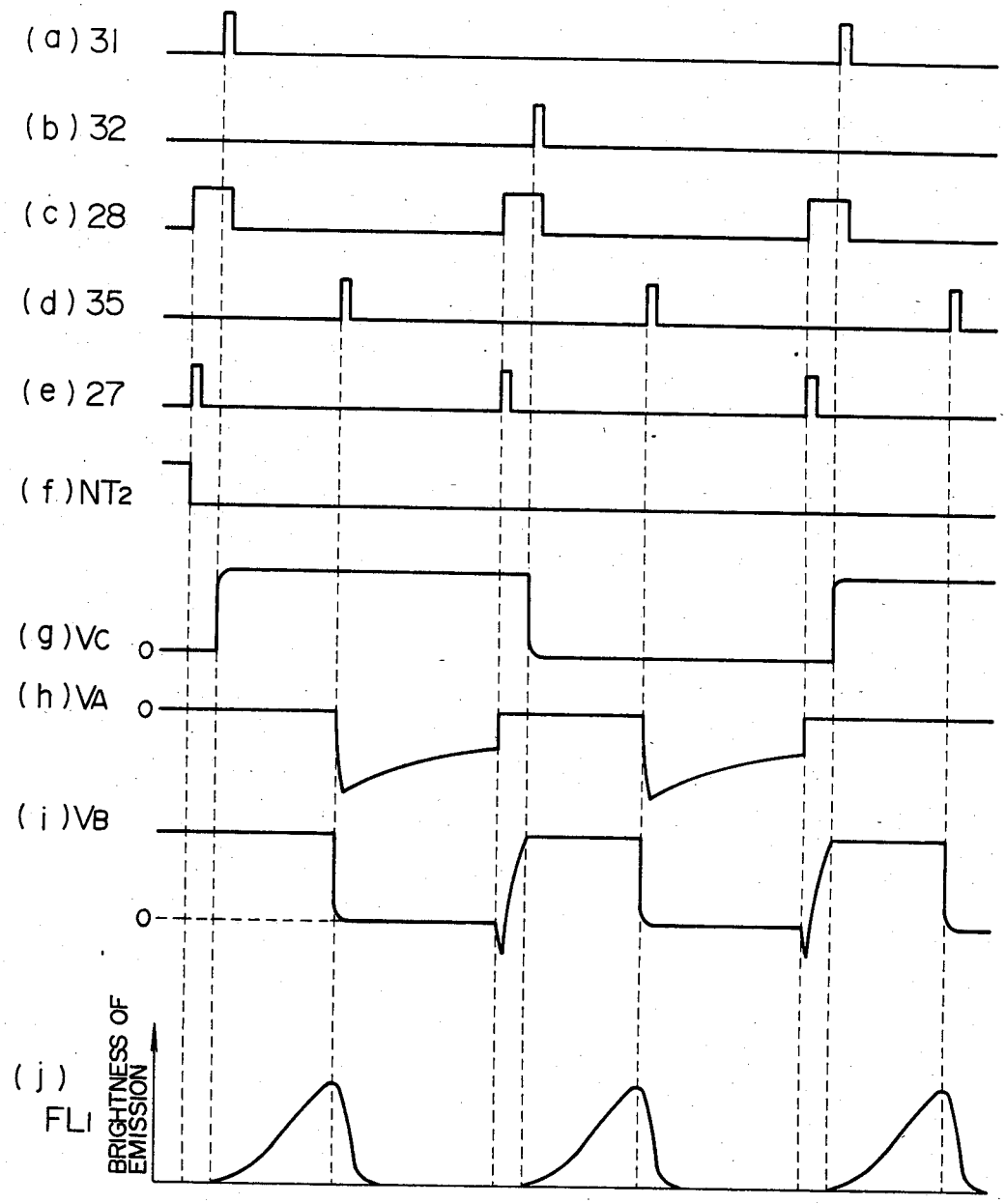
FIGS. 7(*a*) to (*j*) are a series of timing charts which illustrate changes occurring in various outputs from certain points within the electronic flash shown in FIG. 6.

As the synchro contacts SW2 of the camera are closed when the multiple emission mode is selected, the other end of the contacts SW2 assumes its "L" level, which is fed through NOT circuit NT7 to the input of FF21, thus setting it. Hence FF21 delivers a positive output, which is fed through NOT circuit NT6 to the base of the transistor Q3, thus turning it off, as indicated in FIG. 7(*f*). As a result, the trigger capacitor C2 is not charged, but waits for its charging. The positive output from FF21 changes the third input of AND circuit AD11 to its "H" level, whereby this gate is enabled, passing oscillation pulses from the oscillator 2 to be supplied to the input of the frequency divider 24, to the other input of AND circuit AD13 and to the other input of AND circuit AD15. Additionally, the input of the pulse generator 22 assumes its "H" level, and hence it delivers a positive one-shot pulse at its output. The one-shot pulse is fed through OR circuits OR7 and OR8 to the associated inputs of pulse generators 27 and 28, respectively, whereby these generators deliver positive pulses at their outputs, as shown in FIGS. 7(*e*) and (*c*).

The positive pulse delivered by the pulse generator 27 resets the counter 34, and is also fed through the capacitor C6 to fire the thyristor SR4, thus assuring the charging of the commutation capacitor C3. The positive pulse delivered by the pulse generator 28 has a longer duration than the positive pulse delivered by the pulse generator 27, and is fed through the capacitor C5 to trigger the main thyristor SR2 into conduction. This pulse also enables AND circuit AD13, thus allowing oscillation pulses from the oscillator 2 to be fed through AND circuit AD11 to the counter 29. After counting a given number of input pulses, the counter 29 delivers a positive one-shot pulse, which sets FF30. When set, FF30 inverts its output to its "H" level, which is fed through the capacitor C14 and resistor R14 to supply a differentiated pulse to the pulse generator 31, which then delivers a positive one-shot pulse, as indicated in FIG. 7(*a*). This positive one-shot pulse is fed through OR circuit OR6 and the capacitor C11 to fire the trigger thyristor SR5. When the thyristor SR5 is fired, the charging current to the trigger capacitor C2 flows through the thyristor SR5. Since the trigger capacitor C2 is rapidly charged through the thyristor SR5, the potential $V_C$ at one end of the capacitor C2 rises rapidly. When the trigger capacitor C2 is charged, the current flow through the thyristor SR5 reduces below its holding current level and thus the latter becomes turned off. As the trigger capacitor C2 is charged, the same current flows through the primary coil of the trigger transformer T1, thus inducing a high voltage across the secondary coil thereof. The high voltage is applied to the trigger electrode of the flash discharge tube FL1 to excite the latter. Since the main thyristor SR2 remains triggered by the positive output pulse from the pulse generator 28 so as to be capable of conduction (see FIGS. 7(*a*) and (*c*)) at this time, the main capacitor C1 discharges through the discharge tube FL1 and the main thyristor SR2, whereby the discharge tube FL1 initiates the emission of flashlight, as indicated in FIG. 7(*j*).

The positive pulse delivered by the pulse generator 31 is fed through OR circuit OR9 to reset the counter 25 and FF38 and also set FF33. Accordingly, FF33 delivers a positive output, which enables AND circuit AD15, allowing oscillation pulses from the oscillator 2 to be fed through AND circuit AD11 to the counter 34. After counting up to the preset count determined by the signal S5, the counter 34 delivers a positive pulse, which resets FF33 to disable AND circuit AD15, and also activates the pulse generator 35, causing the latter to develop a positive one-shot pulse at its output, as indicated in FIG. 7(*d*). This positive one-shot pulse is fed through OR circuit OR3 and the capacitor C7 to fire the commutating thyristor SR3. When the commutating thyristor SR3 is fired, the potentials $V_A$ and $V_B$ at the opposite ends of the capacitor C3 decrease rapidly, as indicated in FIGS. 7(*h*) and (*i*), and the charge on the commutation capacitor C3 reversely biases the main thyristor SR2, thus turning it off. Accordingly, the emission from the discharge tube FL1 ceases, as indicated in FIG. 7(*j*). The positive one-shot pulse delivered by the pulse generator 35 also resets the counter 29 and causes the counter 36 to count up by one. The pulse also sets FF38, the output of which then inverts to its "H" level, enabling AND circuit AD12. Accordingly, oscillation pulses from the oscillator 2 as divided by the frequency divider 24 are fed to the counter 25, which then begins counting such frequency divided pulses.

When the counter 25 counts up to a preset count determined by the preset count signal S4 or when a time interval between successive emissions which is determined by the signal S4 passes, the counter 25 delivers a positive one-shot pulse, which is fed through OR circuits OR7 and OR8 to be applied to the input of the pulse generators 27 and 28. Accordingly, the pulse generators 27 and 28 each deliver a positive pulse, respectively, (see FIGS. 7(*e*) and (*c*)) in a manner to that when the positive one-shot pulse from the pulse generator 22 is applied thereto, thus firing the thyristors SR2 and SR4 and resetting the counter 34. When the thyristors SR2 and SR4 are fired, the commutation capacitor C3 which has been charged to the opposite polarity as a result of the commutating operation is now rapidly charged in a direction to store the commutating charge (see FIGS. 7(*h*) and 7(*i*)), and when the charging of the capacitor C3 is complete, the thyristors SR2 and SR4 are turned off. However, it should be noted that the main thyristor SR2 remains as triggered by the positive output pulse from the pulse generator 28 so as to be capable of conduction.

Figure 8A:
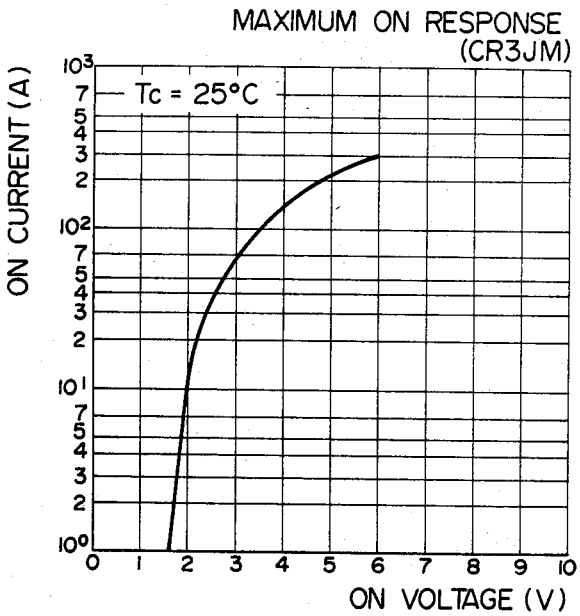
FIGS. 8(A) and (B) graphically show the rating response for a maximum on condition of a thyristor.
Figure 8B:
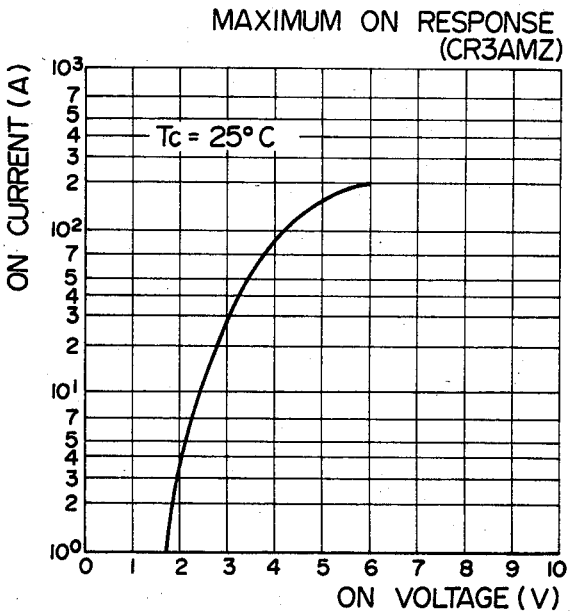

It will be noted that the only resistance present in the charging path of the commutation capacitor C3 when the thyristors SR2 and SR4 are turned on is the on-resistance of these thyristors. FIGS. 8(A) and (B) show an example of the on-resistance of each thyristor. As illustrated, such resistance is on the order of several ohms at most. For example, FIG. 8(A) illustrates the onresistance resistance of a commercial product model CR3JM, manufactured by Mitsubishi Electric Work, Co., which is on the order of 0.02 ohm when energized with 200 A. FIG. 8(B) shows another product model CR3AMZ, manufactured by the same company, which has an on-resistance on the order of 0.03 ohm when energized with 200 A. Accordingly, when substituting specific values of $C_3=2.2\ \mu F$, $R=0.04\ \Omega$, $V_1=300$ V and $V_3=250$ V into the equation (2), the time length $T_1$ required to charge the commutation capacitor C3 to 250 V through the thyristors SR2 and SR4 is given as follows:

$$T_1 = -2.2 \times 10^{-6} \times 0.04 \times \ln\left(1 - \frac{250}{300}\right)$$

$$\approx 0.16 \times 10^{-6}\,\text{s} = 0.00016\ \text{ms}$$

It will be noted that this charging time $T_1$ is by a factor of $10^{-6}$ less than the charging time $T_0=157.6$ ms which has been calculated for the conventional arrangement shown in FIG. 1. In practice, the on-resistance of a switching element such as thyristor varies with the magnitude of a current passing therethrough, but it can be concluded that the commutation capacitor C3 can be charged to 250 V within 1 to 10 $\mu$s, if such variation is taken into consideration. This means a very rapid charging.

When AND circuit AD13 is enabled by the positive output delivered by the pulse generator 28 and the counter 29 begins counting up to a given count, the counter 29 delivers a positive output pulse, upon reaching the given count, which pulse resets FF30 that has been set. Accordingly, the output of FF30 now changes from "H" to "L" level, and the output is fed through NOT circuit NT8 to form a differentiated pulse by means of capacitor C15 and resistor R15. This differentiated pulse is applied to the input of the pulse generator 32. The pulse generator 32 delivers a positive pulse at its output, as shown in FIG. 7(*b*), which pulse is fed through the capacitor C4 to fire the thyristor SR1. When the thyristor SR1 is fired, since the trigger capacitor C2 has already been charged as a result of the firing of the thyristor SR5, the capacitor C2 now discharges through a path including the thyristor SR1 and the primary coil of the trigger transformer T1, thus inducing a high voltage across the secondary coil thereof. Consequently, the flash discharge tube FL1 is excited in a similar manner to that described before, and initiates the emission of flashlight for the second cycle, as indicated in FIG. 7(*j*). It will be noted that the potential $V_C$ at one end of the trigger capacitor C2 declines rapidly during the second emission, as indicated in FIG. 7(*g*).

In a similar manner to the positive pulse delivered by the pulse generator 31, the positive pulse delivered by the pulse generator 32 is fed through OR circuit OR9 to reset the counter 25 and FF38 and to set FF33, whereby AND circuit AD15 is enabled, allowing the counter 34 to begin counting. When the counter 34 counts up and delivers a positive pulse at its output, this pulse resets FF33 to disable AND circuit AD15, and also activates the pulse generator 35, which then delivers a positive one-shot pulse. This positive one-shot pulse is fed through OR circuit OR3 and the capacitor C7 to fire the commutating thyristor SR3. As a consequence, a commutating operation takes place, and the second emission of flashlight from the discharge tube FL1 ceases, as indicated in FIG. 7(*j*). The positive pulse delivered by the pulse generator 35 also resets the counter 29 and sets FF38, allowing the counter 25 to begin counting. The pulse is also fed to the counter 36, causing the latter to count up by one.

In a similar manner, after each emission of flashlight from the discharge tube FL1, the count in the counter 36 is incremented by one. When the counter 36 counts up to a given count determined by the preset count signal S6, it delivers a positive pulse, which causes the pulse generator 37 to deliver a positive one-shot pulse as a reset signal R. This reset signal R is applied to the reset input R of the counters 25 and 36 and to the reset input R of FF30, and is also fed through OR circuit OR10 to be applied to the reset input R of FF21. Accordingly, components 25, 36, 30 and 21 are reset, and the electronic flash of the present embodiment ceases its operation to terminate a multiple emission after the commutating operation.

When the mode switch SW10 is thrown to the fixed terminal $b_0$ to select the synchronized emission mode, one input of AND circuit AD11 receives "L" level, whereby this gate is disabled. Accordingly, the circuit portion which follows the frequency divider 24 and which operates to produce a trigger signal for the multiple emission ceases to operate. On the other hand, one input of AND circuit AD14 receives an "H" level through NOT circuit NT11, and thus is enabled, allowing the delay circuit 23 to operate. Since the other input of AND circuit AD4 receives an "H" level, this gate is also enabled, permitting the photometric circuit to operate for purpose of automatic emission control.

As the synchro contacts SW2 of the camera are closed when the synchronized emission mode is selected, the input of FF21 receives "H" level through NOT circuit NT7, and thus is set. The output of this flipflop is then fed through NOT circuit NT6 to turn the transistor Q3 off, thus enabling the trigger circuit for operation. Since one input of AND circuit AD4 receives an "H" level, its output is fed through NOT circuit NT2 to apply "L" level to the base of the transistor Q1, thus turning it off. Accordingly, a photocurrent produced by the phototransistor PT1 is integrated by the integrating capacitor C8, thus allowing the photometric circuit to begin photometry. The inverted, positive output from FF21 activates the pulse generator 22, which then delivers a positive one-shot pulse. This one-shot pulse is fed through OR circuits OR7 and OR8 to activate the pulse generators 27 and 28, respectively. The positive one-shot pulse delivered by the pulse generator 27 turns the thyristor SR4 on to charge the commutation capacitor C3 while the positive one-shot pulse delivered by the pulse generator 28 triggers the thyristor SR2 into conduction.

The positive one-shot pulse delivered by the pulse generator 22 is fed through AND circuit AD14 to the delay circuit 23, which delivers a positive one-shot pulse after a given time delay. This positive one-shot pulse is fed through OR circuit OR6 and the capacitor C11 to fire the thyristor SR5, thus allowing the charging current to flow to the trigger capacitor C2 through the thyristor SR5. This accompanies a current flow through the primary coil of the trigger transformer T1, thus inducing a high voltage across the secondary coil thereof. This high voltage is applied to the trigger electrode of the discharge tube FL1 to excite it, whereby the latter initiates the emission of flashlight.

When the voltage across the integrating capacitor C8 of the photometric circuit exceeds, as a result of photometry of reflected light from an object being photographed, a reference voltage prevailing at the junction between the resistors VR3 and R9 which is determined on the basis of a film speed and a diaphragm aperture, the output from the comparator or amplifier OP1 inverts, and the inverted output is fed through NOT circuit NT3, OR circuit OR3 and capacitor C7 to fire the thyristor SR3. Accordingly, the commutation capacitor C3 discharges through the thyristor SR3 to reversely bias the main thyristor SR2, thus turning the latter off. In this manner, the synchronized emission from the discharge tube FL1 is automatically controlled to cease the emission. The inverted output from the amplifier OP1 is also fed through NOT circuits NT3, NT10 and NT9 and OR circuit OR10 to be applied to the reset input R of FF21, thus resetting it. The output of this flipflop is fed through AND circuit AD4 and NOT circuit NT2 to turn the transistor Q1 on, thus disabling the photometric circuit. The output of the flipflop 21 is also fed through NOT circuit NT6 to turn the transistor Q3 on, thus short-circuiting the trigger capacitor C2 to disable the trigger circuit. It will therefore be seen that the electronic flash of the present embodiment functions as a normal electronic flash of automatic emission control type whenever the mode switch SW10 is thrown to its fixed terminal $b_0$.

In the embodiment described above, the thyristor SR4 is added to the commutating circuit to speed up the charging time required to charge the commutation capacitor C3. Though it may appear that the charging time of the commutation capacitor C3 can also be reduced by reducing the resistance of the resistor R3, this choice cannot be employed since then the current which should pass through the flash discharge tube FL1 passes through the resistor R3 and the thyristor SR3 whenever the latter thyristor is fired.

The provision of the resistor R3 is not essential, provided the thyristor SR4 is fired before the firing of the thyristor SR3 to assure that the commutation capacitor C3 be charged before the commutating operation takes place.

Figure 9:
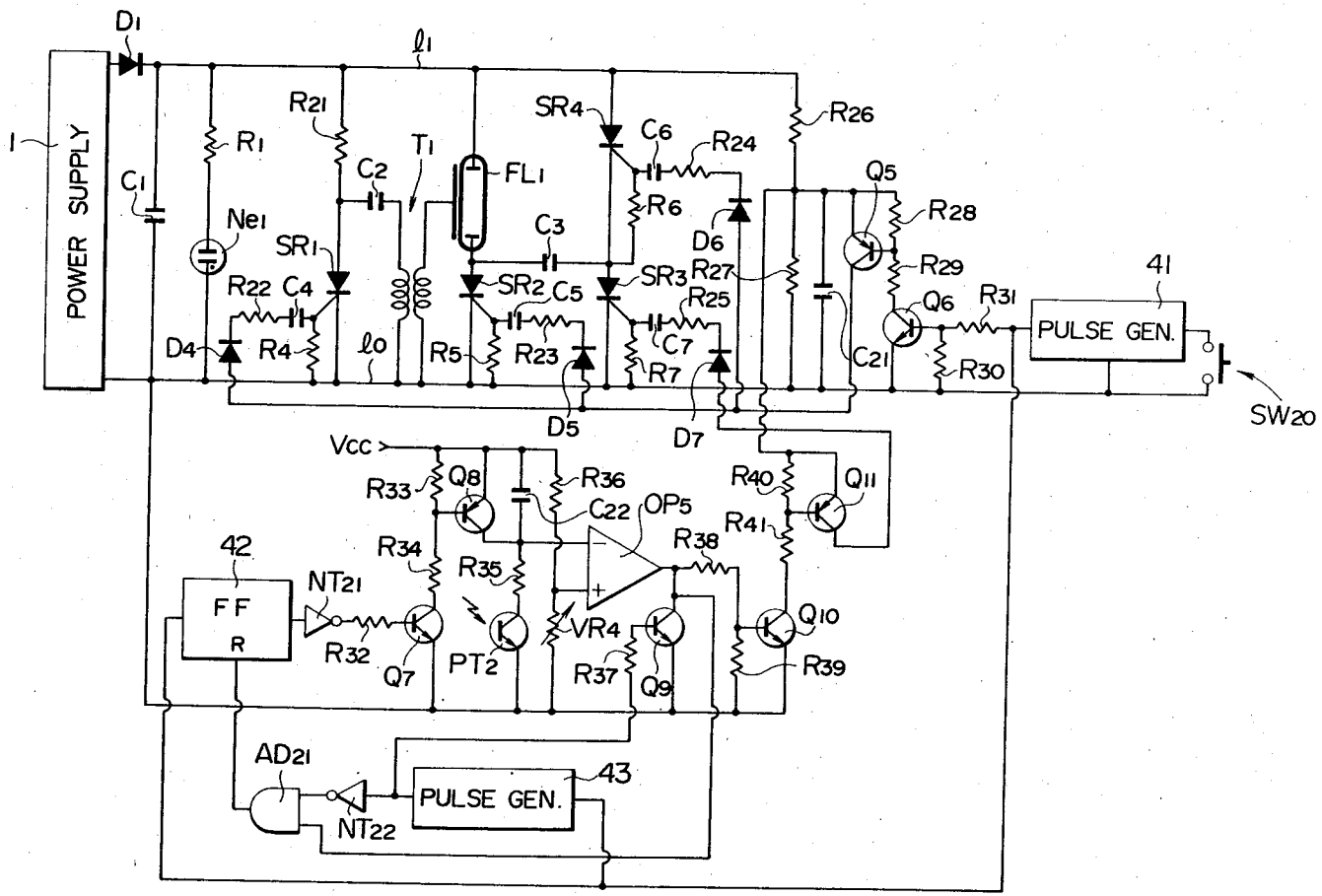
FIG. 9 is a circuit diagram of an electronic flash according to yet another embodiment of the invention which is capable of rapidly charging a commutation capacitor.

FIG. 9 shows the electrical circuit of an electronic flash according to yet another embodiment of the invention which takes into consideration the above factors. This electronic flash is designed to minimize a time lag required to charge the commutation capacitor before the next emission is initiated, by utilizing in a sophisticated manner the fact that the charging of the commutation capacitor is completed before the initiation of the emission from the flash discharge tube if the main thyristor and the thyristor which is used to charge the commutation capacitor are simultaneously triggered.

Referring to FIG. 9, it will be noted that the electrical circuit of the electronic flash shown includes synchro contacts SW20 located within a camera, which have their one end connected to the input of a pulse generator 41 formed by a monostable multivibrator and other end connected through the bus $l_0$ to the circuit 41. The output of the pulse generator 41 is connected to the input of a pulse generator 43 which is similarly formed by a monostable multivibrator, and to the input of FF42, and is also connected through a resistor R31 to the base of an NPN transistor Q6. The transistor Q6 has its base and emitter connected to the negative terminal of the power supply circuit 1 with or without a resistor R30 interposed therebetween, and has its collector connected through a resistor R29 to the base of a PNP transistor Q5. The transistor Q5 has its base connected through a resistor R28 to the emitter thereof, which is in turn connected to the junction between a pair of resistors R26 and R27 connected in series across the main capacitor C1. The resistor R27 is shunted by a capacitor C21. The collector of the transistor Q5 is connected through a diode D4 and a resistor R22 to one end of the capacitor C4, connected through a diode D5 and a resistor R23 to one end of the capacitor C5, and connected through a diode D6 and a resistor R24 to one end of the capacitor C6. It will be noted that the junction between the resistors R26 and R27 is connected to the emitter of a PNP transistor Q11 which will be described later.

The output of the pulse generator 43 is connected through a resistor R37 to the base of an NPN transistor Q9, and also connected through NOT circuit NT22 to one input of AND circuit AD21. The other input of AND circuit AD21 is connected to the collector of the transistor Q9, and the output of AND circuit AD21 is connected to the reset input R of FF42. The output of FF42 is connected through NOT circuit NT21 and a resistor R32 in series to the base of NPN transistor Q7, the emitter of which is connected to the negative terminal of the power supply circuit 1. The collector of the transistor Q7 is connected through series resistors R34, R33 to the supply of the operating voltage Vcc. The junction between the resistors R33 and R34 is connected to the base of a PNP transistor Q8. The transistor Q8 has its emitter connected to the supply of the operating voltage Vcc and its collector connected to the junction between an integrating capacitor C22 and a resistor R35. The capacitor C22 has its one end connected to the supply of the operating voltage Vcc and its other end connected to one end of the resistor R35, the other end of which is connected to the collector of a phototransistor PT2 which is used for purpose of photometry. The phototransistor PT2 has its emitter connected to the negative terminal of the power supply circuit 1. The junction between the capacitor C22 and the resistor R35 is connected to the inverting input of a comparator OP5, the non-inverting input of which is connected to the junction between a resistor R36 and a variable resistor VR4 which are in turn connected in series between the supply of the operating voltage Vcc and the negative terminal of the power supply circuit 1. The output of the comparator OP5 is connected to the collector of the transistor Q9 and is also connected through a resistor R38 to the base of an NPN transistor Q10. The emitter of the transistor Q9 is connected to the negative terminal of the power supply circuit 1, and the base of the transistor Q10 is also connected to the negative terminal of the power supply circuit 1 through a resistor R39. The transistor Q10 has its emitter connected to the negative terminal of the power supply circuit 1 and has its collector connected through a resistor R41 to the base of the PNP transistor Q11. The transistor Q11 has its base connected through a resistor R40 to the junction between the resistors R26 and R27 and has its emitter connected directly to the junction between these resistors. The collector of the transistor Q11 is connected through a diode D7 and a resistor R25 in series to one end of the capacitor C7.

It will be noted that the electrical circuit of the electronic flash of the present embodiment does not include a parallel combination of coil L1 and diode D2 in series with the flash discharge tube FL1. Also it will be noted that one end of the trigger capacitor C2 is connected through a resistor R21 to the cathode of the diode D1.

In operation, when the synchro contacts SW20 located within the camera are turned on, the pulse generator 41 delivers a positive one-shot pulse, which turns on the transistor Q6 for a given time interval. As the transistor Q6 is turned on, the transistor Q5 is turned on, whereby a trigger voltage is applied to the gates of each of the thyristors SR1, SR2 and SR4 through diodes D4, D5 and D6, resistors R22, R23, R24 and capacitors C4, C5, C6, respectively, thus firing these thyristors. As the thyristor SR1 is turned on, the discharge of the trigger capacitor C2 induces a high voltage across the secondary coil of the trigger transformer T1, which is applied to the trigger electrode of the flash discharge tube FL1 to excite it. Since the thyristors SR2 and SR4 are turned on simultaneously, the commutation capacitor C3 is charged rapidly. The charging of the commutation capacitor C3 is completed within a time interval on the order of several microseconds, whereupon the thyristor SR4 is automatically turned off. By contrast, the thyristor SR2 is maintained on as a result of the current flow from the discharge tube FL1, and the discharge tube FL1 initiates the emission of flashlight after 10 to 20 microseconds. It will thus be seen that the charging of the commutation capacitor C3 is completed before the initiation of the emission of flashlight from the discharge tube FL1.

On the other hand, the one-shot pulse delivered by the pulse generator 41 is also applied to FF42, which inverts to produce an output of "H" level, which is in turn applied to turn the transistors Q7 and Q8 off, allowing the integrating capacitor C22 to begin to be charged by the photocurrent produced by the photodiode PT2. This means that the photometric circuit begins to operate for automatic emission control. The one-shot pulse delivered by the pulse generator 41 is also applied to the pulse generator 43, which produces a positive pulse having a duration of a time interval which is required to charge the commutation capacitor C3 to cause the thyristor SR4 to be turned off. Accordingly, as long as such pulse is present, the transistor Q9 remains on to maintain the output of the comparator OP5 at its "L" level. After the positive output pulse from the pulse generator 43 terminates, when the voltage across the integrating capacitor C22 exceeds a reference voltage applied to the non-inverting input of the comparator OP5, or the voltage Vcc as divided by the resistors R36 and VR4, the comparator OP5 inverts from "L" to "H" level, whereby the transistors Q10 and Q11 are turned on, feeding a trigger voltage through diode D7, resistor R25 and capacitor C7 to the gate of the thyristor SR3, thus turning it on. Consequently, a commutating operation takes place by the discharge of the commutation capacitor C3, ceasing the emission of flashlight from the discharge tube FL1.

When the output of the pulse generator 43 returns to its "L" level and the output of the comparator OP5 inverts to its "H" level, AND circuit AD21 produces an output of "H" level, so that a signal of "H" level is applied to the reset input R of FF42, which is reset to its initial condition or an output of "L" level.

As mentioned previously, the time $T_0$ required to charge the commutation capacitor C3 to 250 V with a conventional electronic flash will be approximately equal to 157.6 ms, and when variations in the capacitance of the capacitor or the resistance of the resistor is taken into consideration, the required charging time will be on the order of 200 ms. Accordingly, when the arrangement is mounted on a motor drive, the maximum rate will be nearly five frames per second when the synchronization with the photographing process is considered. Accordingly, if a user attempts to try a synchronized emission at a rate greater than five frames per second with a conventional electronic flash, a failure of the commutating operation will probably occur since the commutation capacitor C3 is not charged sufficiently.

However, with the electronic flash of the invention, while the commutation capacitor C3 is charged in synchronism with the triggering of the flash discharge tube FL1, the charging of the commutation capacitor C3 is completed (1 to 10 μs) before the initiation of the emission from the discharge tube. By that time, the thyristor SR4 which is used to charge the commutation capacitor is turned off, and hence it can be concluded truthfully that a time lag between the termination of one emission and the initiation of the next emission is equal to zero. This means that the electronic flash of the invention can be used for performing a high rate consecutive photographing operation which takes pictures at a rate greater than five frames per second, which affords a great convenience in practical use.

What is claimed is:

1. A commutation capacitor and a circuit for rapidly charging said commutation capacitor, comprising:

a first switching element connected in series with a flash discharge tube;

the commutation capacitor having one end connected to the junction between the flash discharge tube and the first switching element;

a second switching element connected to the other end of the commutation capacitor to initiate a commutating operation by the capacitor;

a third switching element connected in series with the second switching element across one of a group of elements including a power supply and a main capacitor;

and means for applying a trigger signal to the third switching element when the flash tube and the first switching element are conductive, to to rapidly charge the commutation capacitor.

2. A circuit according to claim 1 in which said first, second and third switching elements each comprise a thyristor.

3. An electronic flash comprising:

a first switching element connected in series with a flash discharge tube;

a commutation capacitor having its one end connected with the junction between the flash discharge tube and the first switching element;

a second switching element connected to the other end of the commutation capacitor to enable a commutating operation by the commutating capacitor;

a third switching element connected in series with the second switching element across a power supply or a main capacitor;

and means becoming operative in synchronism with the triggering operation of the flash discharge tube for repeatedly applying a trigger signal to the first, the second and the third switching element in a given sequence, thereby allowing the flash discharge tube to produce a continued emission at a substantially constant brightness level;

an oscillator, and a counter for counting output pulses from the oscillator, said trigger means being disabled by an output from the counter when a given time interval has passed since the initiation of operation of said trigger means, thereby assuring that a continued emission from the flash discharge tube is maintained for the given time interval.

4. An electronic flash comprising:

a first switching element connected in series with a flash discharge tube;

a commutation capacitor having its one end connected with the junction between the flash discharge tube and the first switching element;

a second switching element connected to the other end of the commutation capacitor to enable a commutating operation by the commutation capacitor;

a third switching element connected in series with the second switching element across a power supply or a main capacitor;

and means becoming operative in synchronism with the triggering operation of the flash discharge tube for repeatedly applying a trigger signal to the first, the second and the third switching element in a given sequence, thereby allowing the flash discharge tube to produce a continued emission at a substantially constant brightness level;

said trigger means comprising an oscillator, and a counter for counting output pulses from the oscillator, thereby supplying signals to the second, the first and the third switching elements in a sequential manner at given time intervals.

5. An electronic flash comprising:

a first switching element connected in series with a flash discharge tube;

a commutation capacitor having its one end connected with the junction between the flash discharge tube and the first switching element;

a second switching element connected to the other end of the commutation capacitor to enable a commutating operation by the commutation capacitor;

a third switching element connected in series with the second switching element across a power supply or a main capacitor;

and means becoming operative in synchronism with the triggering operation of the flash discharge tube for repeatedly applying a trigger signal to the first, the second and the third switching element in a given sequence, thereby allowing the flash discharge tube to produce a continued emission at a substantially constant brightness level;

said trigger means comprising a brightness detector including a photoelectric transducer element disposed adjacent to the flash discharge tube for detecting the brightness level of the emission from the discharge tube, an oscillator, a counter for counting output pulses from the oscillator, and a delay circuit responsive to an output from the counter, said trigger means being operative to deliver a trigger signal to tne second switching element in response to an output from the brightness detector whenever the brightness of the emission from the discharge tube has reached a given level, to deliver a trigger signal to the first switching element in response to an output from the counter whenever a given time interval has passed since the brightness has reached the given level, and to deliver a trigger signal to the third switching element after a further time interval.

6. An electronic flash comprising:

a first switching element connected in series with a flash discharge tube;

a commutation capacitor having its one end connected with the junction between the flash discharge tube and the first switching element;

a second switching element connected to the other end of the commutation capacitor to enable a commutating operation by the commutation capacitor;

a third switching element connected in series with the second switching element across a power supply or a main capacitor;

and means becoming operative in synchronism with the triggering operation of the flash discharge tube for repeatedly applying a trigger signal to the first, the second and the third switching element in a given sequence, thereby allowing the flash discharge tube to produce a continued emission at a substantially constant brightness level;

a fourth switching element for triggering the flash discharge tube, the fourth switching element being rendered conductive in synchronism with the initiation of a photographing operation of an associated camera.

7. An electronic flash comprising:

a first switching element connected in series with a flash discharge tube;

a commutation capacitor having its one end connected with the junction between the flash discharge tube and the first switching element;

a second switching element connected to the other end of the commutation capacitor to enable a commutating operation by the commutation capacitor;

a third switching element connected in series with the second switching element across a power supply or a main capacitor;

and means becoming operative in synchronism with the triggering operation of the flash discharge tube for repeatedly applying a trigger signal to the first, the second and the third switching element in a given sequence, thereby allowing the flash discharge tube to produce a continued emission at a substantially constant brightness level;

a photometric circuit connected to the second switching element to provide an automatic emission control, and an emission mode changeover switch having a pair of terminals, the switch having a switch member engaging one of the terminals to disable the photometric circuit to establish a continued emission mode and engaging the other terminal to disable said means for applying a trigger signal, to establish a synchronized emission mode in which an automatic emission control is effected.

8. An electronic flash according to claim 7, further including a fourth switching element which triggers the flash discharge tube, the fourth switching element being rendered conductive in synchronism with the initiation of a photographing operation of an associated camera when the changeover switch is thrown to one of its terminals and being rendered conductive in synchronism with the full opening of a shutter of an associated camera when the changeover switch is thrown to the other terminal.

9. An electronic flash according to claim 8 in which the fourth switching element comprises a thyristor.

10. A method of operating an electronic flash including a first switch for connecting the electronic flash to a power source;

a trigger circuit including a trigger capacitor for igniting the electronic flash;

a second switch for discharging the trigger capacitor;

a commutation capacitor having one end coupled to the second switch and third and fourth switches coupled to the other end of the commutation capacitor for respectively discharging the commutation capacitor and for coupling the commutation capacitor to a charging source;

a photometry circuit for measuring the emission level of the electronic flash;

said method comprising the steps of:

(a) firing said first and second switches for igniting the electronic flash and connecting the electronic flash to the power source;

(b) firing the third switch for discharging the commutation capacitor into the first switch to reduce the emission level of the electronic flash responsive to the photometry circuit detecting a predetermined emission level;

(c) firing the first switch to increase the emission level of the electronic flash;

(d) firing the fourth switch to recharge the commutation capacitor.

11. The method of claim 10 further comprising repeating steps (b) through (d) in the order set forth for a predetermined interval and thereafter terminating repetition of steps (b) through (d) to thereby terminate emission of the electronic flash.

12. A trigger circuit for triggering a flash discharge tube, comprising:

a trigger capacitor connected in a trigger circuit for the flash discharge tube;

a first switching element connected in a discharge path of the trigger capacitor;

a second switching element connected in series with the first switching element across at least one element including a power supply and a main capacitor;

means for interrupting the discharge of the flash discharge tube;

and means for alternately applying a trigger signal to the first and the second switching element, thereby allowing the flash discharge tube to be triggered by the charging and the subsequent discharge of the trigger capacitor.

13. A trigger circuit according to claim 12 in which each of the first and the second switching elements comprises a thyristor.

14. An electronic flash comprising:

a first switching element connected in series with a flash discharge tube;

a commutation capacitor having one end connected to the junction between the flash discharge tube and the first switching element;

a second switching element connected to the other end of the commutation capacitor to enable a commutating operation by the capacitor;

a third switching element connected in series with the second switching element across at least one element of a group including a power supply and a main capacitor;

a trigger capacitor connected in a trigger circuit of the flash discharge tube;

a fourth switching element connected in a discharge path of the trigger capacitor;

a fifth switching element connected in series with the fourth switching element across at least one element of a group including a power supply and the main capacitor;

and trigger means responsive to the closure of synchro contacts of an associated camera for repeatedly applying a trigger signal to the first to the fifth switching elements in a given sequence;

whereby the flash discharge tube is enabled to produce an interrupted multiple emission.

15. An electronic flash according to claim 14 in which said trigger means comprises an oscillator and a counter for counting output pulses from the oscillator, said means delivering signals which sequentially render the first, the third and the second switching elements conductive at given time intervals and also delivering signals which alternately render the fifth and the fourth switching element conductive in connection with the signal which renders the first switching element conductive.

16. An electronic flash according to claim 14, further including a sixth switching element connected in parallel with the fourth switching element, the sixth switching element being normally turned on to short-circuit the trigger capacitor, the sixth switching element being turned off in synchronism with the closure of the synchro contacts of a camera to permit charging and discharging of the trigger capacitor through the fifth and the fourth switching element, respectively.

17. An electronic flash according to claim 14, further including a photometric circuit connected to the second switching element to provide an automatic emission control, and an emission mode changeover switch having a pair of terminals, the changeover switch having a switch element for connection to one of the terminals to disable the photometric circuit to establish a multiple emission mode and for connection to the other terminal to disable said trigger means to establish a synchronized emission mode in which an automatic emission control is effective.

18. An electronic flash according to claim 17, further including a delay circuit responsive to the closure of the synchro contacts of a camera, the multiple emission being initiated in synchronism with the closure of the snychro contacts whenever the changeover switch is thrown to said one terminal, the synchronized emission being inititated with a predetermined delay with respect to the closure of the synchro contacts in response to an output from the delay circuit whenever the changeover switch is thrown to the other terminal.

19. An electronic flash according to claim 14, further including a counter which counts the number of emissions from the flash discharge tube, the counter producing an output when a given number of emissions have been obtained from the flash discharge tube after the closure of the synchro contacts of a camera to thereby cease the operation of said means, thus assuring that a given number of emissions be produced from the flash discharge tube.

20. An electronic flash according to claim 14 in which said first to the fifth switching elements each comprises a thyristor.

21. An electronic flash according to claim 16 in which the sixth switching element comprises a transistor.

22. An electronic flash comprising:

a flash discharge tube;

a first switching element connected in series with said flash discharge tube;

a commutation capacitor having a first end connected with the junction between the flash discharge tube and the first switching element;

a second switching element connected to the other end of the commutation capacitor to initiate a commutation operation by the commutation capacitor;

means for connecting the commutation capacitor to at least one element of a group including a power supply and a main capacitor for charging the commutation capacitor;

first trigger means for repeatedly rendering the second switching element conductive to interrupt conduction of the first switching element;

second trigger means for repeatedly rendering the first switching element conductive after conduction of the first switching element has been interrupted and before the light emitted by the flash discharge tube has disappeared to maintain substantially constant flash brightness.

23. An electronic flash according to claim 22 in which the first, the second and the third switching element each comprises a thyristor.

24. An electronic flash according to claim 22 wherein said means for charging said commutation capacitor includes a third switching element and means for closing said third switching element to cause charging of the commutation capacitor through said first and third switching elements.

25. A method of operating an electronic flash including:

a first switch for connecting the electronic flash to a power source;

a trigger circuit including a trigger capacitor for igniting the electronic flash;

a second switch for discharging the trigger capacitor;

a commutation capacitor having one end coupled to the second switch and third and fourth switches coupled to the other end of the commutation capacitor for respectively discharging the commutation capacitor and for coupling the commutation capacitor to a charging source; said method comprising the steps of:

(a) firing said first and second switches for igniting the electronic flash and connecting the electronic flash to the power source;

(b) firing the third switch for discharging the commutation capacitor into the first switch to reduce the emission level of the electronic flash;

(c) firing the first switch to increase the emission level of the electronic flash;

(d) firing the fourth switch to recharge the commutation capacitor.

26. The method of claim 25 further comprising repeating steps (b) through (d) in the order set forth for a predetermined interval and thereafter terminating repetition of steps (b) through (d) to thereby terminate emission of the electronic flash.

27. The method of claim 25 further comprising the step of firing the fourth switch simultaneously with the firing of the first and second switches to charge the commutation capacitor.

28. A method for operating an electronic flash including a first switch for coupling the electronic flash to a power source;

a trigger circuit including a trigger capacitor for igniting the electronic flash;

a second switch for discharging the trigger capacitor;

a third switch, a commutation capacitor coupled between the first and third switches and a fourth switch for coupling the commutation capacitor to a power source, the method comprising the steps of:

firing the first and fourth switches to charge the commutation capacitor which turns off the first and fourth switches when charged;

firing the second and fourth switches to ignite the electronic flash and complete the electrical circuit between the electronic flash and the power source;

firing the second switch after a predetermined interval to discharge the commutation capacitor and thereby turn off the switch and hence the electronic flash.

29. The method of claim 28 further comprising the step of firing a fifth switch for coupling power to the trigger capacitor and simultaneously firing the first switch to initially charge the trigger capacitor and thereafter ignite the electronic flash and complete the electrical circuit between the power source and the electronic flash.

* * * * *

UNITED STATES PATENT AND TRADEMARK OFFICE

CERTIFICATE OF CORRECTION

PATENT NO. : 4,591,762

DATED : May 27, 1986

INVENTOR(S) : Hiroaki Nakamura

It is certified that error appears in the above-identified patent and that said Letters Patent is hereby corrected as shown below:

Column 3, line 7, change "$T_0 = -2.2 \times 10^{-6} \times 40 \times 10^3 \times \ln (1 - 250/300)$" to --$T_0 = -2.2 \times 10^{-6} \times 40 \times 10^3 \times \ell n (1 - 250/300)$--;

lines 9 and 10, change, " $\approx$157.6 ms" to -- $\approx$ 157.6 ms--.

Column 7, line 11, change "$l_0$" to -- $\ell_0$--;
line 14, change "$l_0$" to -- $\ell_0$--;
line 17, change "$l_0$" to -- $\ell_0$--;
line 21, change "$l_1$" to -- $\ell_1$--;
line 23, change "$l_1$" to -- $\ell_1$--;
line 38, change "a" (seocnd occurrence) to --a--;
line 41, change "b" to --b--.

Column 9, line 8, change "a" to --a--.

Column 11, line 6, change "a" to --a--;
line 17, change "b" to --b--;
line 37, change "b" to --b--;
line 47, change "b" to --b--;

Column 12, line 5, change "b" to --b--.

Column 13, line 35, change "a" to --a--.

Column 15, line 41, change "b" to --b--.

UNITED STATES PATENT AND TRADEMARK OFFICE

CERTIFICATE OF CORRECTION

PATENT NO. : 4,591,762

DATED : May 27, 1986

INVENTOR(S) : Hiroaki Nakamura

It is certified that error appears in the above-identified patent and that said Letters Patent is hereby corrected as shown below:

Column 16, line 13, change "b" to --$\underline{b}$--;
line 24, change "$l_1$" to --$\ell_1$--.

Column 20, line 26, change,
"$T_1 = -2.2 \times 10^{-6} \times 0.04 \times \ln (1-250/300)$" to
--$T_1 = -2.2 \times 10^{-6} \times 0.04 \times \ell n (1-250/300)$--;
line 29, change,
"$\approx 0.16 \times 10^{-6}$s = 0.00016ms" to
--$\approx 0.16 \times 10^{-6}$s = 0.00016ms"

Column 23, line 2, change "$l_0$" to --$\ell_0$--.

Signed and Sealed this

Twenty-ninth Day of September, 1987

*Attest:*

DONALD J. QUIGG

*Attesting Officer* *Commissioner of Patents and Trademarks*

UNITED STATES PATENT AND TRADEMARK OFFICE

CERTIFICATE OF CORRECTION

PATENT NO. : 4,591,762

DATED : May 27, 1986

INVENTOR(S) : HIROAKI Nakamura

It is certified that error appears in the above-identified patent and that said Letters Patent is hereby corrected as shown below:

Column 25, line 55, delete "to", first occurrence.

Signed and Sealed this

Eighth Day of December, 1987

*Attest:*

DONALD J. QUIGG

*Attesting Officer*

*Commissioner of Patents and Trademarks*